US006367379B1

(12) United States Patent
Toda

(10) Patent No.: US 6,367,379 B1
(45) Date of Patent: Apr. 9, 2002

(54) DOUBLE-SIDED PRINTING APPARATUS AND DOUBLE-SIDED PRINTING METHOD

(75) Inventor: Yasunori Toda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/624,392

(22) Filed: Jul. 27, 2000

(30) Foreign Application Priority Data

Oct. 15, 1999 (JP) ..... 11-293685

(51) Int. Cl.[7] ..... B41F 13/06; B41F 13/02
(52) U.S. Cl. ..... 101/220; 101/232
(58) Field of Search ..... 399/68, 16, 384, 399/396; 400/611, 618, 617; 101/220, 212, 216, 219, 228, 232

(56) References Cited

U.S. PATENT DOCUMENTS 5,481,352 A * 1/1996 Yamamoto et al. ..... 399/384
5,548,390 A * 8/1996 Sugisaki et al. ..... 399/364

FOREIGN PATENT DOCUMENTS

| | | |
|---|---|---|
| JP | 57-144779 | 9/1982 |
| JP | 2-225253 | 9/1990 |
| JP | 3-10867 | 1/1991 |
| JP | 5-305744 | 11/1993 |
| JP | 6-144670 A * | 5/1994 |
| JP | 8-143197 | 6/1996 |

* cited by examiner

*Primary Examiner*—Daniel J. Colilla
(74) *Attorney, Agent, or Firm*—Armstrong, Westerman & Hattori, LLP

(57) ABSTRACT

A double-sided printing apparatus which includes two printers each including a tractor unit, a fixing unit and scuff rollers is improved in that, even if a printed surface of continuous recording paper contacts with the scuff rollers, stain to the print does not occur. The double-sided printing apparatus includes a tractor unit for forming a print image on the rear surface of continuous recording paper and transporting the continuous recording paper in a forward direction, a flash fixing unit for fixing the print image formed on the continuous recording paper to the continuous recording paper, scuff rollers capable of transporting the continuous recording paper in the forward direction and outputting transport amount information, and a tension control section for controlling the tractor unit and the scuff rollers so that the continuous recording paper has a predetermined tension when printing of the continuous recording paper is started. In the rear surface printing apparatus, fixed acceleration control is performed for the tractor unit and the scuff rollers, and a predetermined tension is applied to the continuous paper.

6 Claims, 15 Drawing Sheets

DOUBLE-SIDED PRINTING APPARATUS AND DOUBLE-SIDED PRINTING METHOD

BACKGROUND OF THE INVENTION

1) Field of the Invention

This invention relates to a double-sided printing apparatus and a double-sided printing method suitable for use for printing on front and rear surfaces of continuous recording paper, for example, by an electrophotographic method.

2) Description of the Related Art

In recent years, in a field of development of printers for continuous recording paper (a continuous medium), various double-sided printing apparatus have been placed on the market from various manufacturers. A double-sided printing apparatus is an apparatus for printing on both of the front surface and the rear surface of continuous recording paper by an electrophotographic method and includes two printers each of which can print on one surface of continuous recording paper and are connected to each other via a turn bar for turning over the continuous recording paper.

FIG. 12 is a schematic view of a double-sided printing apparatus. Referring to FIG. 12, the double-sided printing apparatus 80 shown includes a pair of printers 80*a* and 80*d*, a turn bar 80*b*, and a transport relaying apparatus 80*c*. Continuous recording paper 100 is printed on the front surface thereof by the printer 80*a* and turned over by the turn bar 80*b*. Then, the continuous recording paper 100 is transported through the transport relaying apparatus 80*c* and then printed on the rear surface thereof by the printer 80*d*. In this manner, the front and rear surfaces of the continuous recording paper 100 are printed by the two printers 80*a* and 80*d* which are connected to each other.

FIG. 13 is a schematic view of the printer 80*d*. The printer 80*d* shown in FIG. 13 prints on the rear surface of the continuous recording paper 100 discharged from the transport relaying apparatus 80*c*, and the continuous recording paper 100 released from the transport relaying apparatus 80*c* is loaded into the printer 80*d*. Then, the continuous recording paper 100 is transported by a tractor unit 95 which includes a pair of tractor belts 95*a* and 95*c* and a tractor motor 95*b*. During such transportation, toner powder sticking to a photosensitive drum 90*e* is transferred to the continuous recording paper 100 by a transfer charger (not shown) provided in the tractor unit 95 so that a print image is formed on the continuous recording paper 100. Then, the toner powder is fixed to the continuous recording paper 100 by heat in a flash fixing unit 91. Thereafter, the continuous recording paper 100 is stored into a paper folding unit 94*b* under the guidance of a pair of scuff rollers 92*b* and 92*a*. The scuff rollers 92*b* and 92*a* are rotating at an equalvelocity. A pair of pinch rollers 93*a* and 93*b* cooperate with the scuff rollers 92*a* and 92*b*, respectively, to transport the continuous recording paper 100.

As a mechanism for transporting the continuous recording paper 100, the tractor unit 95 shown in FIG. 13 serves as main transport means for transporting the continuous recording paper 100 and the scuff rollers 92*b* and 92*a* take up the continuous recording paper 100.

Meanwhile, toner power is transferred to a surface of the continuous recording paper 100 in accordance with a following flow. Referring to FIG. 13, the photosensitive drum 90*e* rotates in the clockwise direction. During rotation, the surface of the photosensitive drum 90*e* is first charged uniformly by a precharger 90*c*, and then, an electrostatic latent image of data to be printed is formed on the surface of the photosensitive drum 90*e* by exposure to light by an exposure station 90*d*. Then, the electro static latent image is developed into a toner image by a developing unit 90*g*, and the toner powder on the photosensitive drum 90*e* is transferred to the surface the continuous recording paper 100 by the transfer charger in the tractor unit 95. Meanwhile, remaining toner powder on the photosensitive drum 90*e* is removed by a cleaner station 90*b*. Then, the surface of the photosensitive drum 90*e* is charged uniformly by the precharger 90*c* again in order to prepare for a next transferring step.

Now, velocity variations of the tractor motor 95*b* in the tractor unit 95 and scuff motors in the scuff rollers 92*b* and 92*a* are described with reference to FIGS. 14(*a*), 14(*b*) and 15(*a*), 15(*b*), and also operation for keeping the tensile force of the continuous recording paper 100 is described. It is to be noted that the transport velocity of the tractor unit 95 is hereinafter referred to as main transport velocity, and the transport velocity of the scuff rollers 92*b* and 92*a* is hereinafter referred to as scuff transport velocity. Further, the direction along which the continuous recording paper 100 is printed and transported may be hereinafter referred to as forward direction or printing transport direction, and the direction opposite to the direction may be hereinafter referred to as reverse direction.

FIG. 14(*a*) is a diagram illustrating the velocity variation of the tractor motor upon starting of printing, and FIG. 14(*b*) is a diagram illustrating the velocity variation of the scuff motors upon starting of printing. The characteristic illustrated in FIG. 14(*a*) is a characteristic of the tractor motor 95*b* in the tractor unit 95, and the characteristic illustrated in FIG. 14(*b*) is a characteristic of the scuff motors (not shown) for driving the scuff rollers 92*b* and 92*a*.

In a section denoted by A in FIG. 14(*b*), the scuff rollers 92*b* and 92*a* are started earlier than the tractor unit 95 to increase the tension of the continuous recording paper 100 (stretch the continuous recording paper 100 in a taut state). Also during printing, in order to assure a high tension to the continuous recording paper 100, the scuff transport velocity is set higher by approximately 5 to 30% than the main transport velocity.

FIG. 15(*a*) is a diagram illustrating the velocity variation of the tractor motor upon stopping of printing, and FIG. 15(*b*) is a diagram illustrating the velocity variation of the scuff motors upon stopping of printing. A velocity curve 90*a* shown in FIG. 15(*a*) indicates the main transport velocity. In FIG. 15(*a*), the tractor motor first rotates in the forward direction at a velocity $V_1$ and then rotates reversely at another velocity $-V_2$ after the velocity becomes equal to zero. Here, both of $V_1$ and $V_2$ are positive values. The reason why the rotation is reversed is that it is intended to adjust the printing position of the continuous recording paper 100 to a position suitable when next printing is to be started.

Meanwhile, the velocity curve 90*b*' shown in FIG. 15(*b*) indicates the scuff transport velocity. The scuff transport velocity exhibits such a variation that the scuff motor continues to rotate forwardly at a velocity higher by approximately 5 to 30% than the main transport velocity and still continues its forward rotation even after the tractor unit 95 starts its backward transportation, and then stops after the tractor unit 95 stops its backward transportation. Therefore, in a section denoted by B in FIG. 15(*b*), the scuff rollers 92*b* and 92*a* rotate forwardly so that the continuous recording paper 100 is taken up by them and a predetermined tension of the continuous recording paper 100 is obtained thereby.

As described above with reference to FIGS. 14(*a*), 14(*b*), 15(*a*) and 15(*b*), the scuff rollers 92*b* and 92*a* operate to increase the tension of the continuous recording paper 100. In other words, they operate in such a manner as described in the following paragraphs ① to ③.

① During printing, the scuff rollers 92*b* and 92*a* are set in an excessively feeding condition wherein the scuff velocity is higher by approximately 5 to 30% than the main transport velocity so that the continuous recording paper 100 may have a predetermined tension in order to prevent a slack (buffer) of the continuous recording paper 100. Consequently, good transportability and fixing stability of the continuous recording paper 100 are obtained in the flash fixing unit 91.

② When transportation of the continuous recording paper 100 is started, the scuff rollers 92*b* and 92*a* are started earlier, for example, by approximately 3 seconds or more than starting of printing so that they may rotate but idly so that the continuous recording paper 100 may not become slackened thereby to assure transportability and fixing stability of the continuous recording paper 100 upon starting.

③ As an operation unique to the printer for continuous recording paper, upon stopping of printing, the continuous recording paper 100 stops after it is transported backwardly by approximately 1 to 4 inches. Also during such backward transportation, the scuff rollers 92*b* and 92*a* rotate forwardly so that the continuous recording paper 100 may have a predetermined tension at the flash fixing unit 91 thereby to make preparations for next printing.

Since the system described above merely requires control of the timings of starting and stopping and the velocities of rotation, it is advantageous in that an inexpensive scuff motor can be used and transportability and fixing stability of the continuous recording paper 100 are achieved.

Further, where the system described above is used for single-sided printing, no rubbing of the printed surface occurs in any case as described in the following paragraphs ④ to ⑥.

④ While the scuff transport velocity during printing is higher by approximately 5 to 30%, since the pinch rollers 93*a* and 93*b* (refer to FIG. 13) which contact with the printed surface side of the continuous recording paper 100 are driven rollers and rotate at a velocity equal to the velocity at which the continuous recording paper 100 is transported, no stain to the print by rubbing of the printed surface occurs.

⑤ Also upon starting, even if the scuff rollers 92*b* and 92*a* are started at a sudden timing, the pinch rollers 93*a* and 93*b* do not rotate, and consequently, no stain to the print by rubbing of the printed surface occurs similarly. The sudden timing signifies that the velocity increases suddenly.

⑥ When backward transportation upon stopping of printing of the continuous recording paper 100 is performed or when the continuous recording paper 100 is transported in the reverse direction, since the pinch rollers 93*a* and 93*b* rotate together with the continuous recording paper 100, no stain to the print by rubbing of the printed surface occurs either.

Therefore, when single-sided printing is performed, no stain to the print occurs even if the continuous recording paper 100 is transported using the scuff rollers 92*b* and 92*a*. On the other hand, when double-sided printing is performed, during printing described in the paragraph ① above, since the velocity of the scuff rollers 92*b* and 92*a* is higher by approximately 5 to 30% than the transport velocity, the difference between the velocities is sufficiently small and no stain to the print occurs.

However, when double-sided printing is performed, since the scuff rollers 92*b* and 92*a* are used to transport the continuous recording paper 100, a surface of the continuous recording paper 100 which has been printed by the first printer 80*a* faces the scuff rollers 92*b* and 92*a* of the second turn bar 80*b*. Consequently a pressure called pinch pressure of each of the scuff rollers 92*a* and 92*b* is applied to the surface of the continuous recording paper 100 printed by the first printer 80*a*, and this pressure removes toner powder from the surface of the continuous recording paper 100 and causes stain to the print.

In particular, when the scuff rollers 92*b* and 92*a* are in such an idle rotation condition as described in paragraph ② above, since the velocity difference is as great as approximately 105% to 130%, a high pinch pressure is applied to the print and this causes stain to the print. Also while the continuous recording paper 100 is backwardly transported as in paragraph ③ above, since the scuff rollers 92*b* and 92*a* are rotating forwardly, the velocity difference is as high as approximately 205% to 235% and this causes stain to the print.

Accordingly, the system described above has a subject to be solved in that, where it is used for double-sided printing, since a printed surface of the continuous recording paper 100 faces the scuff rollers 92*b* and 92*a* and the scuff transport velocity and the main transport velocity are different from each other, the printed surface is rubbed with the scuff rollers 92*b* and 92*a* and this deteriorates the picture quality of the print.

SUMMARY OF THE INVENTION

It is an object of the present invention to provide a double-sided printing apparatus of the type wherein two electrophotographic printers each including a tractor unit, a flash fixing unit and scuff rollers are connected to each other, and a double-sided printing method for the double-sided printing apparatus by which, even if a printed surface of continuous recording paper contacts with the scuff rollers, no stain to the print is caused by the scuff rollers.

In order to attain the object described above, according to the present invention, fixed acceleration control of the tractor units and the scuff rollers is performed, and a predetermined tension is applied to the continuous recording paper.

More particularly, according to an aspect of the present invention, there is provided a double-sided printing apparatus, comprising front surface printing means for printing on a front surface of a continuous medium and transporting the continuous medium in a printing transport direction, paper turning over means provided on the printing transport direction side of the front surface printing means for turning over the continuous medium to reverse the front and rear surfaces of the continuous medium and transporting the continuous medium in the printing transport direction, and rear surface printing means provided on the printing transport direction side of the paper turning over means for printing on the rear surface of the continuous medium and transporting the continuous medium in the printing transport direction, the rear surface printing means including main transport means for forming a print image on the rear surface of the continuous medium and transporting the continuous medium in the printing transport direction, fixing means provided on the downstream side of the main transport means in the printing transport means for fixing the print image formed on the continuous medium to the continuous medium, scuff transport means provided on the downstream side of the fixing means in the printing transport means for transporting the continuos medium in the printing transport means and outputting transport amount information, fixed acceleration control means for controlling the transport velocity of the main transport means and the transport velocity of the scuff transport means with fixed accelerations, and tension control means for controlling the main transport means and the scuff transport means so that the continuous medium may have a predetermined tension when printing of the continuous medium is started.

The double-sided printing apparatus is advantageous in that rubbing of the print on the continuous medium is eliminated and further in that, since the continuous medium is controlled to a state wherein it has a predetermined tension, stain to the print does not occur.

The tension control means may control the scuff transport means and the main transport means so that the main transport means is activated after a predetermined time after the scuff transport means is activated.

The tension control means may control the main transport means and the scuff transport means so that the scuff transport means is stopped earlier than the main transport means to generate a slack having a predetermined amount of the continuous medium and then the scuff transport means and the main control means are activated at the same timing to transport the continuous medium by a predetermined distance in a direction opposite to the printing transport direction to eliminate the slack generated on the continuous medium. In this instance, the tension control means may include feed amount management control means for determining the predetermined distance from the transport amount information outputted from the scuff transport means. And the tension control means may include slack amount detection means for detecting a slack amount of the continuous medium being transported between the main transport means and the scuff transport means to determine the predetermined distance.

With the double-sided printing apparatus, since the continuous medium is transported backwardly while it remains in a slackened state, there is an advantage that rubbing of the print on the continuous medium can be prevented.

According to another aspect of the present invention, there is provided a double-sided printing method, comprising a paper loading step of printing data to be printed on the front surface of a continuous medium, transporting the continuous medium in a printing transport direction, turning over the continuous medium to reverse the front and rear surfaces of the continuous medium and transporting the continuous medium in the printing transport direction, a scuff transport step of transporting the continuous medium with a fixed acceleration in the printing transport direction to take up the continuous medium which has a print image fixed to the rear surface thereof, a main transport step of forming a print image on the rear surface of the continuous medium after a predetermined time after the scuff transport step is started and transporting the continuous medium with a fixed acceleration in the printing transport direction, a detection step of detecting a slack amount of the continuous medium before the continuous medium being transported by the main transport step is stopped, and a paper tension keeping step of stopping, when the transportation in the printing transport direction is to be stopped, the scuff transportation after the slack amount detected by the detection step is eliminated after the main transportation is stopped and stopping, when the transportation in a direction opposite to the printing transport direction is to be stopped, the main transportation after the slack amount detected by the detection step is eliminated after the scuff transport is stopped.

The double-sided printing method is advantageous in that, even if a surface of a continuous medium printed by performing double-sided printing by means of two single-sided printing apparatus connected to each other in such a state that the scuff transport velocity and the main transport velocity are different from each other contacts with a scuff roller, no stain to the print from the scuff roller occurs, and consequently a print image of good quality can be obtained.

According to a further aspect of the present invention, there is provided a double-sided printing method, comprising a paper loading step of printing data to be printed on the front surface of a continuous medium, transporting the continuous medium in a printing transport direction, turning over the continuous medium to reverse the front and rear surfaces of the continuous medium and transporting the continuous medium in the printing transport direction, a scuff transport step of forming a print image on the rear surface of the continuous medium and transporting the continuous medium with a fixed acceleration in the printing transport direction, a main transport step of transporting the continuous medium, which has a print image fixed to the rear surface thereof, with a fixed acceleration in the printing transport direction simultaneously with the scuff transport step, a slack generating step of stopping the transportation of the continuous medium after the scuff transportation is stopped to generate a slack of the continuous medium, and a reverse transport step of transporting the continuous medium in a direction opposite to the printing transport direction at the same timing as the continuous medium is scuff transported in the direction opposite to the printing transport direction.

The double-sided printing method is advantageous in that a continuous medium can be transported stably from immediately after printing is started.

The above and other objects, features and advantages of the present invention will become apparent from the following description and the appended claims, taken in conjunction with the accompanying drawings in which like parts or elements denoted by like reference symbols.

BRIEF DESCRIPTION OF THE DRAWINGS

FIG. 5(*b*) is a diagram illustrating a velocity control method for a scuff motor in the first embodiment of the present invention;

FIG. 9(*b*) is a diagram illustrating a fixed acceleration control method for a scuff motor in the second embodiment of the present invention;

FIG. 14(*b*) is a diagram illustrating a velocity variation of a scuff motor upon starting of printing;

FIG. 15(*b*) is a diagram illustrating a velocity rotation of a scuff motor upon stopping of printing.

DESCRIPTION OF THE PREFERRED EMBODIMENTS

In the following, embodiments of the present invention are described with reference to the accompanying drawings.

(A) First Embodiment of the Invention

Figure 1:
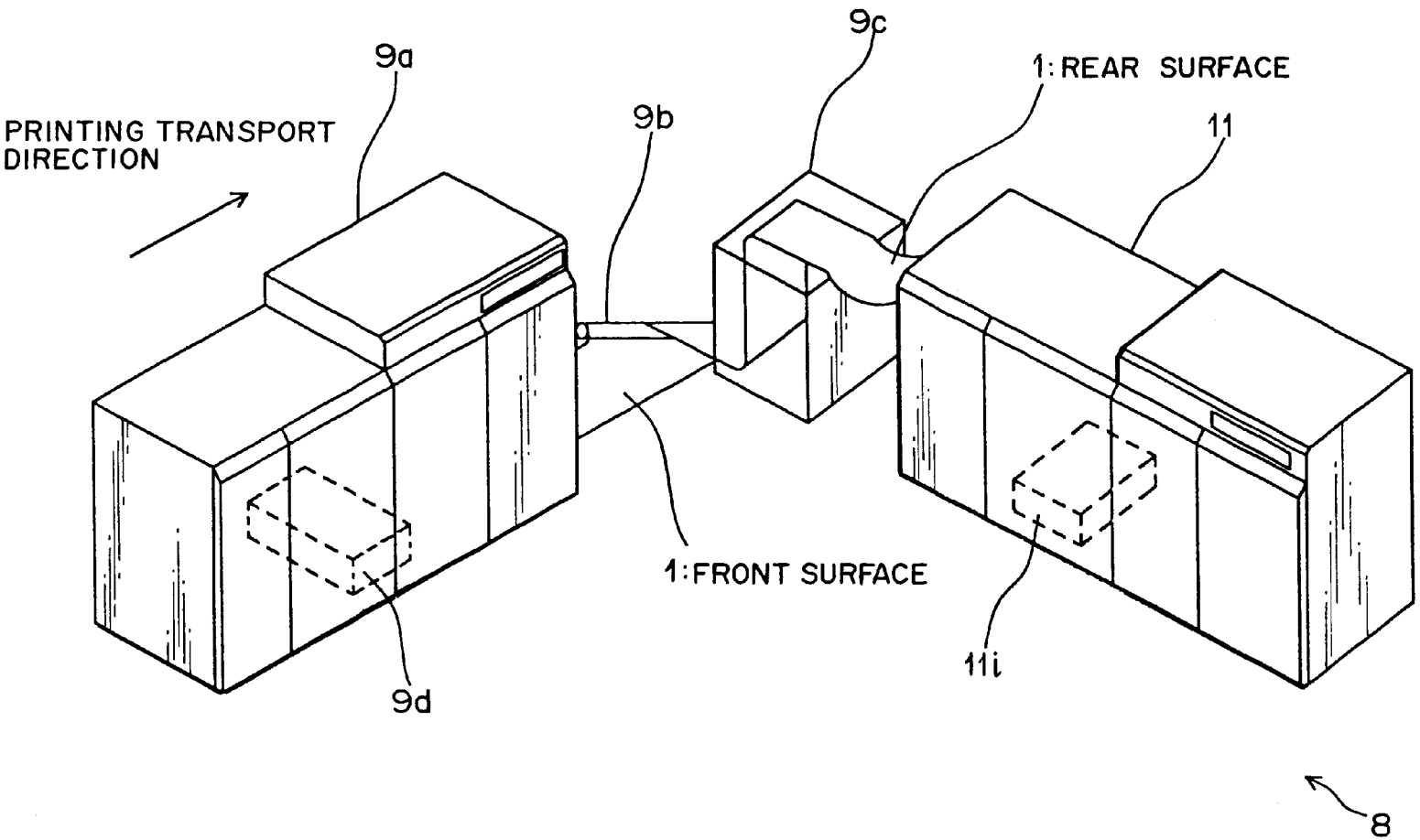
FIG. 1 is a schematic view showing a construction of a double-sided printing apparatus to which the present invention is applied.

FIG. 1 is a schematic view showing a construction of a double-sided printing apparatus to which the present invention is applied. Referring to FIG. 1, the double-sided printing apparatus 8 shown performs electrophotographic printing on the opposite surfaces of continuous recording paper 1 and includes a front surface printing apparatus 9*a*, a turn bar 9*b*, a transport relaying apparatus 9*c*, and a rear surface printing apparatus 11.

The front surface printing apparatus 9*a* prints on the front surface of continuous recording paper 1 and transports the continuous recording paper 1 in a printing transport direction, and includes a paper folding unit 9*d* in which the continuous recording paper 1 is stored. The turn bar 9*b* is provided on the printing transport direction side of the front surface printing apparatus 9*a* in the printing transport direction and turns over the continuous recording paper 1 to reverse the front and rear faces of the continuous recording paper 1. The transport relaying apparatus 9*c* transports the continuous recording paper 1 from the turn bar 9*b* in the printing transport direction. The turn bar 9*b* and the transport relaying apparatus 9*c* cooperatively function as paper turning over means. The rear surface printing apparatus 11 is provided on the downstream side of the transport relaying apparatus 9*c* in the printing transport direction for printing on the rear surface of the continuous recording paper 1 and transporting the continuous recording paper 1 in the printing transport direction. The rear surface printing apparatus 11 has a paper folding unit for storing the printed continuous recording paper 1.

Thus, the continuous recording paper 1 is printed on the front surface thereof by the front surface printing apparatus 9*a* and released from the front surface printing apparatus 9*a*. Then, the continuous recording paper 1 is loaded through the turn bar 9*b* and the transport relaying apparatus 9*c* into the rear surface printing apparatus 11, by which the rear surface thereof is printed.

It is to be noted that, in the following description, the printing transport direction may sometimes be referred to as forward direction, and the direction opposite to this direction may sometimes be referred to as reverse direction. Further, transportation of the continuous recording paper 1 in the reverse direction may sometimes be referred to as backward transportation. Furthermore, the double-sided printing apparatus 8 has the same construction also in a second embodiment of the present invention which is hereinafter described.

Figure 2:
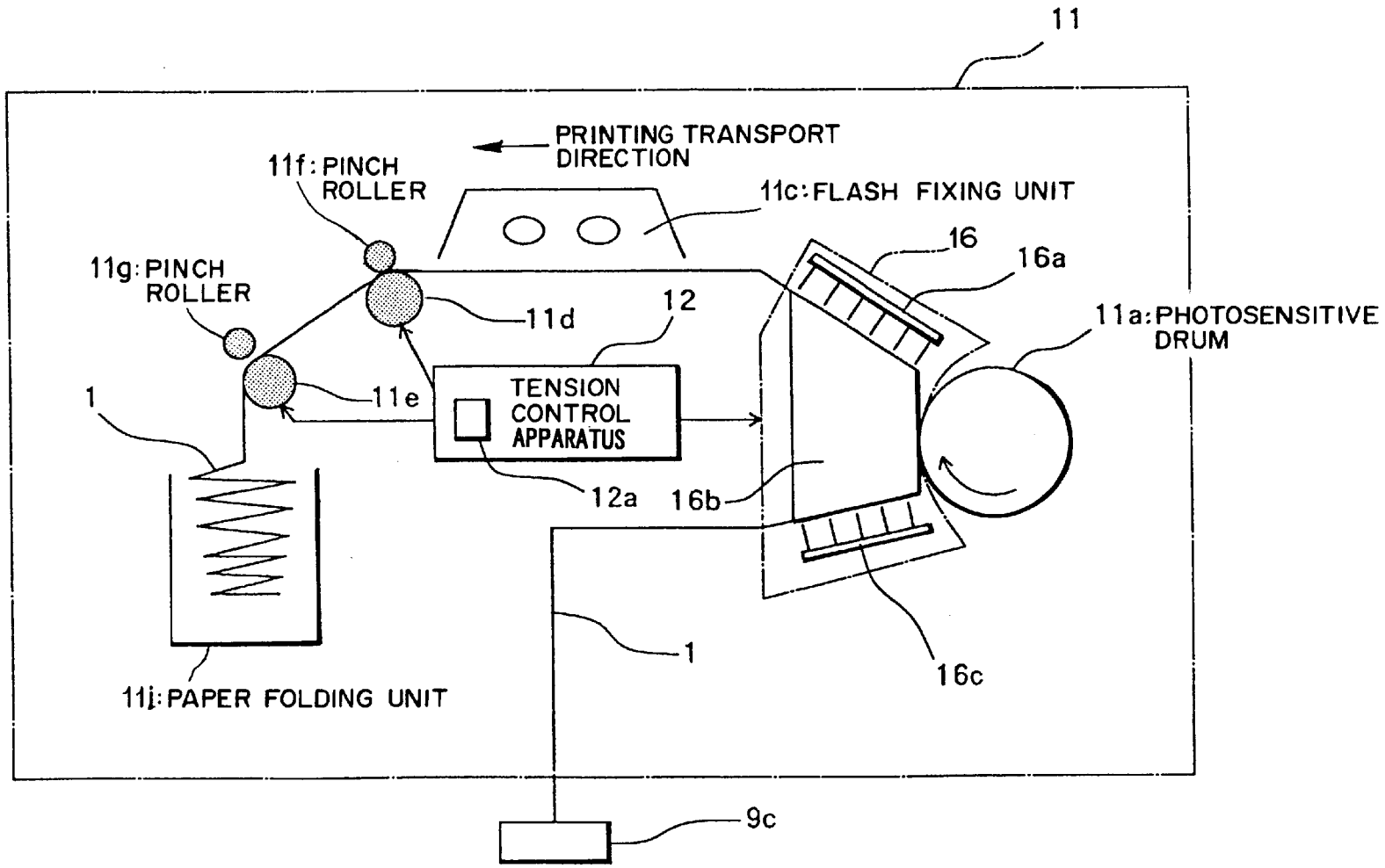
FIG. 2 is a schematic view of a rear surface printing apparatus according to a first embodiment of the present invention.

FIG. 2 is a schematic view of the rear surface printing apparatus 11 according to a first embodiment of the present invention. Referring to FIG. 2, the rear surface printing apparatus 11 is provided on the downstream side of the transport relaying apparatus 9*c* in the forward direction, and prints on the rear surface of the continuous recording paper 1 and transports it in the forward direction. The rear surface printing apparatus 1 includes a photosensitive drum 11*a*, a tractor unit 16, a flash fixing unit 11*c*, a pair of scuff rollers 11*d* and 11*e*, a pair of pinch rollers 11*f* and 11*g*, a paper folding unit 11*i*, and a tension control apparatus 12.

The photosensitive drum 11*a* transfers toner powder to the continuous recording paper 1 therefrom. It is to be noted that description of the other parts for performing electrophotographic printing is omitted herein.

The tractor unit 16 forms a print image on the rear surface of the continuous recording paper 1 and transports the continuous recording paper 1 in the forward direction. The tractor unit 16 includes a pair of tractor belts 16*a* and 16*c* for transporting the continuous recording paper 1, and a tractor motor 16*b* for driving the tractor belts 16*a* and 16*c*, and functions as main transport means. Further, the tractor unit 16 transfers toner powder on the photosensitive drum 11*a* to the continuous recording paper 1 by means of a transfer charger (not shown) provided therein, and transports the continuous recording paper 1 having the toner powder transferred thereto in the forward direction shown in FIG. 2 by means of the tractor belts 16*a* and 16*c* and the tractor motor 16*b*.

The flash fixing unit 11*c* is provided on the downstream side of the tractor unit 16 in the forward direction and fixes a print image formed on the continuous recording paper 1. The rear surface printing apparatus 11 thus functions as fixing means. It is to be noted that the flash fixing unit 11*c* is not activated when the continuous recording paper 1 is transported backwardly.

The scuff rollers 11*d* and 11*e* are provided on the downstream side of the flash fixing unit 11*c* in the forward direction, and transport the continuous recording paper 1 in the forward direction and can output transport amount information. The scuff rollers 11*d* and 11*e* thus function as scuff transport means. More particularly, each of the scuff rollers 11*d* and 11*e* are respectively driven by a scuff motor (scuff motor 11*d*' hereinafter described in connection with the second embodiment). It is to be noted that the transport amount information signifies the number of rotations of the motors and the velocity of rotation of the motors.

The pinch rollers 11*f* and 11*g* are driven rollers for transporting the continuous recording paper 1. The paper folding unit 11*i* folds the continuous recording paper 1 and stores the continuous recording paper 1 in a folded state.

The continuous recording paper 1 released from the transport relaying apparatus 9*c* is transported to the tractor unit 16, in which a print image is formed on the rear surface of the continuous recording paper 1. Then, the continuous recording paper 1 is transported in the forward direction to the flash fixing unit 11*c*, in which the printed image is fixed to the continuous recording paper 1. Further, the continuous recording paper 1 is transported in the forward direction by the scuff rollers 11*d* and 11*e* and stored into the paper folding unit 11*i*.

The tension control apparatus 12 can control the tractor unit 16 and the scuff rollers 11*d* and 11*e* so that, upon starting of printing on the continuous recording paper 1, the continuous recording paper 1 may have a predetermined tension, and includes a fixed acceleration control apparatus 12*a*. The fixed acceleration control apparatus 12*a* can control the transport velocity of the tractor unit 16 and the transport velocity of the scuff rollers 11*d* and 11*e* with fixed accelerations.

In particular, the tension control apparatus 12 controls such that the scuff rollers 11*d* and 11*e* are started first and then the tractor unit 16 is activated after a predetermined time so that the continuous recording paper 1 may have a predetermined tension when the tractor unit 16 starts its transportation. More particularly, the tension control apparatus 12 controls such that, when transportation is started, the continuous recording paper 1 may be in a predetermined tensioned state between the tractor unit 16 and the scuff rollers 11*d* and 11*e* in order to prevent stain to the print and secure the fixing stability of the flash fixing unit 11*c*. In order to give the continuous recording paper 1 a predetermined tension upon starting of printing, the following three methods (i) to (iii) are considered.

(i) The scuff rollers 11*d* and 11*e* are started earlier than the tractor unit 16.

(ii) When the continuous recording paper 1 is to be stopped during transportation thereof in the forward direction and has some slack, the paper folding unit 11*i* is taken up to eliminate the slack.

(iii) When the continuous recording paper 1 is to be stopped during backward transportation and has some slack, the paper folding unit 11*i* is taken up to eliminate the slack.

Method (i)

The tension control apparatus 12 controls the scuff rollers 11*d* and 11*e* such that the scuff rollers 11*d* and 11*e* are started first and then the tractor unit 16 is started after a predetermined time so that the continuous recording paper 1 may have a predetermined tension. The tension control apparatus 12 is provided to prevent a surface of the continuous recording paper 1 from suffering from stain to the print caused by a pinch pressure when the scuff rollers 11*d* and 11*e* are started earlier.

Figure 3:
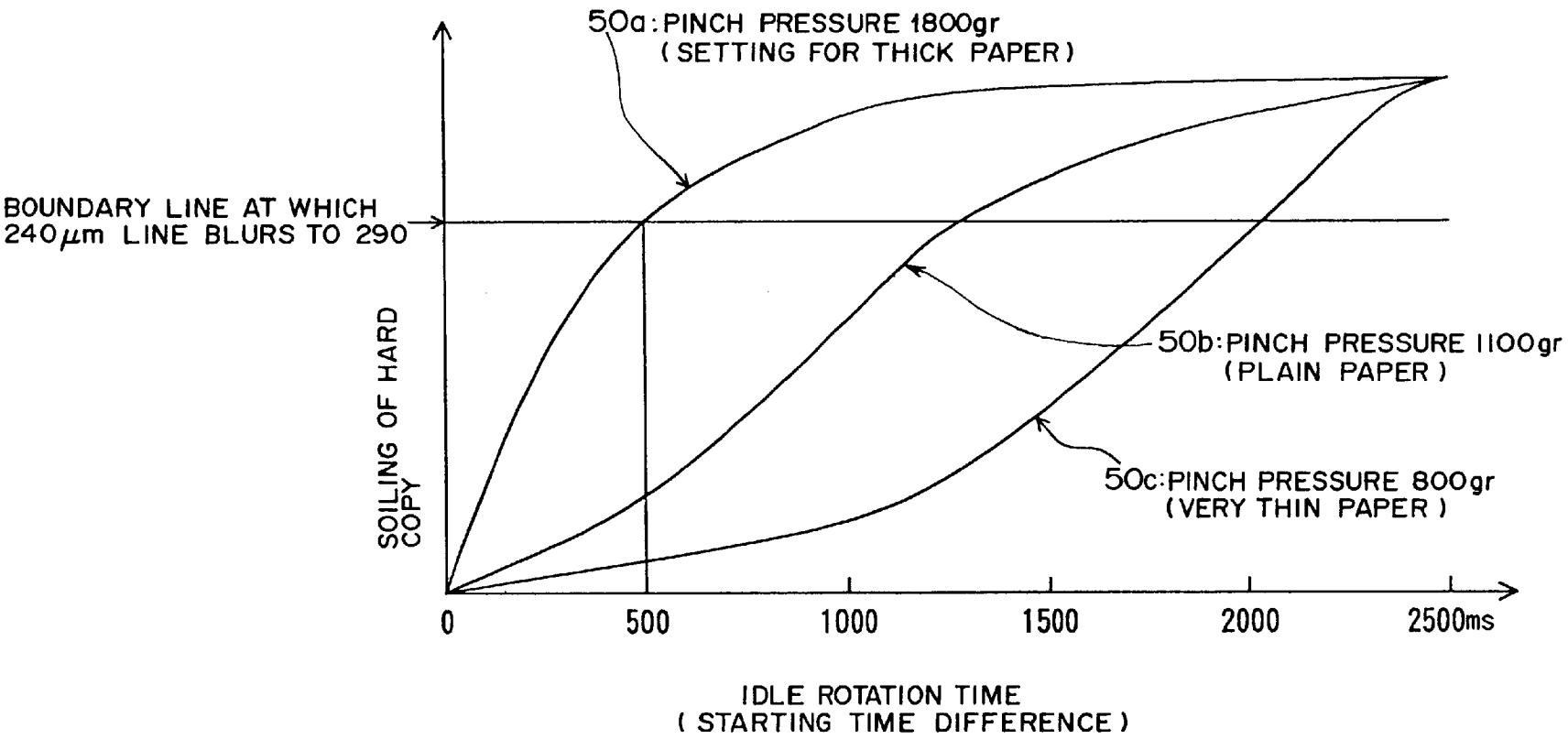
FIG. 3 is a diagram illustrating a pinch pressure applied in the first embodiment of the present invention.

FIG. 3 is a diagram illustrating a pinch pressure in the first embodiment of the present invention. The pinch pressure is exerted by the scuff rollers 11*d* and 11*e* and applied to a surface of the continuous recording paper 1, and increases as the velocity of idle rotation of the scuff rollers 11*d* and 11*e* increases. The velocity of idle rotation is a velocity of the scuff rollers 11*d* and 11*e* when a fixed idle rotation time elapses after they start rotation from their stopping state, and when the scuff rollers 11*d* and 11*e* whose velocity of idle rotation reaches the velocity of idle rotation are brought into contact with the continuous recording paper 1, a pinch pressure is applied to the continuous recording paper 1. Then, if the scuff rollers 11*d* and 11*e* having a higher velocity of rotation are brought into contact with a surface of the continuous recording paper 1, then stain to the print is caused by them. The axis of abscissa of FIG. 3 indicates the idle rotation time (ms) of the scuff rollers 11*d* and 11*e*, and the axis of ordinate indicates the amount of stain to the print (absolute or abstract number). Further, a boundary line representative of an allowable blurring amount is shown in FIG. 3. The boundary line on the axis of ordinate is a line representing the condition that a line segment of 240 $\mu$m printed on the continuous recording paper 1 becomes a line segment of 290 $\mu$m due to blurring.

In FIG. 3, curves 50*a*, 50*b* and 50*c* regarding the pinch pressure characteristic are indicated for three different pinch pressures which were obtained by an experiment. The curve 50*a* indicates the pinch pressure characteristic when the scuff rollers 11*d* and 11*e* are idly rotated with a pinch pressure set for printing on thick paper. From the curve 50*a*, it can be seen that, where the starting time difference is within approximately 500 ms, the blurring amount is within the allowable blurring amount, but where the starting time difference is greater than the value, the pinch pressure applied from the scuff rollers 11*d* and 11*e* to the continuous recording paper 1 becomes so great that removal of toner powder occurs and the blurring amount becomes excessively great,which causes stain to the print. Similarly,the curve 50*b* indicates the pinch pressure characteristic when the scuff rollers 11*d* and 11*e* are idly rotated with a pinch pressure set for printing on plain paper. Where the starting time difference is within approximately 1,200 ms, the blurring amount is within the allowable blurring amount. Further, the curve 50*c* indicates the pinch pressure characteristic when the scuff rollers 11*d* and 11*e* are idly rotated with a pinch pressure set for printing on very thin paper. Where the starting time difference is within approximately 2,100 ms, the blurring amount is within the allowable blurring amount.

Accordingly, from the values obtained by the experiment, printing conditions are set for thick paper for which the shortest idle rotation time is required, and the idle rotation time is set to approximately 500 ms or less to print on the three different types of paper.

It is to be noted that, in order to prevent slackening of the continuous recording paper 1 during printing, each velocity of the scuff rollers 11*d* and 11*e* is set higher by approximately 5 to 30% than the transport velocity of the tractor unit 16 to transport the continuous recording paper 1. Further, the characteristics of the pinch pressure illustrated in FIG. 3 similarly apply to the second embodiment which is hereinafter described.

Method (ii)

When transportation of the continuous recording paper 1 is to be stopped while the continuous recording paper 1 is being transported in the forward direction after it is printed on the rear surface thereof, the stopping operation is performed after the continuous recording paper 1 is taken up to remove a slack. In particular, if transportation is stopped while a slack remains on the continuous recording paper 1 during transportation in the forward direction, then stain to the print occurs upon re-starting of printing, which Method (ii) serves to prevent.

Method (iii)

Upon resuming the printing operation, the continuous recording paper 1 is backwardly transported so that it is positioned accurately. Also when the backward transportation is being performed, if the backward transportation is stopped while a slack remains on the continuous recording paper 1, then stain to the print still occurs upon re-starting of printing. Therefore, the continuous recording paper 1 is taken up to eliminate the slack immediately before the backward transportation is stopped.

Figure 4:
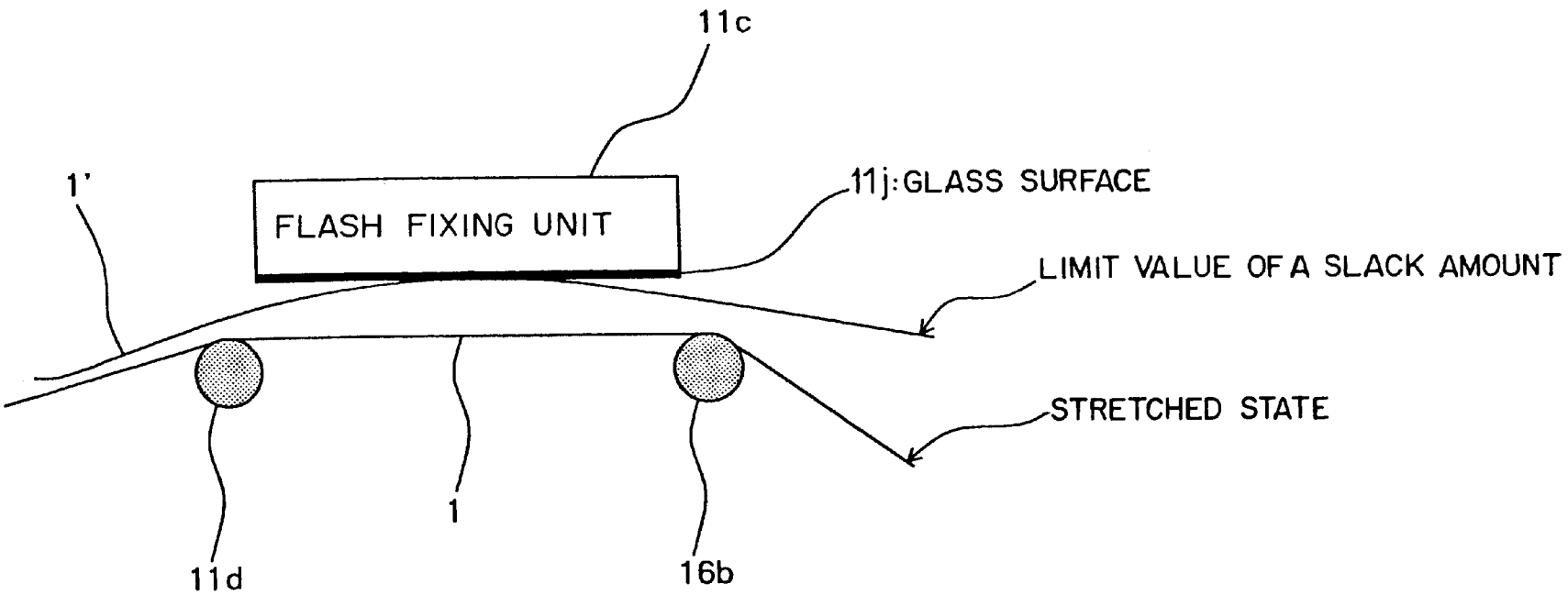
FIG. 4 is a schematic view illustrating a limit value to a slack amount in the first embodiment of the present invention.

On the other hand, if backward transportation is to be performed while a slack remains on the continuous recording paper 1, then this must be performed such that the slackening continuous recording paper 1 may not interfere with other parts. FIG. 4 is a diagram illustrating a limit value to a slack value in the first embodiment of the present invention. Referring to FIG. 4, the bottom face of the flash fixing unit 11*c* shown is formed as a glass surface 11*j*. Further, continuous recording paper 1 and continuous recording paper 1' are shown between the flash fixing unit 11*c* and the tractor motor 16*b* and scuff roller 11*d*. Further, the distance between the tractor motor 16*b* and the scuff roller 11*d* is approximately 500 mm to 1,000 mm, and the flash fixing unit 11*c* is disposed between them. It is to be noted that the tractor motor 16*b* is indicated by a circle for the convenience of illustration.

The continuous recording paper 1 is shown in a state wherein it has a predetermined tension between the tractor motor 16*b* and the scuff roller 11*d*. Meanwhile, the continuous recording paper 1' is shown in another state wherein it is slackened between the tractor motor 16*b* and the scuff roller 11*d*, and is indicated by an imaginary line (arc) representing that the slack amount of the continuous recording paper 1' is at its limit. The limit is defined by the fact that the continuous recording paper 1' contacts with the glass surface 11*j*, and the paper path length of the continuous recording paper 1' in this situation is longer by approximately +5 to +10 mm than the paper path length of the continuous recording paper 1 when the continuous recording paper 1 is stretched with the predetermined tension during transportation thereof. Here, the paper path length signifies the length of the continuous recording paper 1' equal to that of an arc defined by the continuous recording paper 1' between the tractor motor 16*b* and the scuff roller 11*d*.

The time T required to eliminate the slack described above is calculated in accordance with the following expression (1), and T=140 ms is obtained:

$$T=LBUF/(VT\times 0.05)=140\ \text{ms} \quad (1)$$

where LBUF is the amount of the slack of the paper, and VT is the transport velocity of the tractor unit 16 (tractor motor 16*b*) and particularly is 20,000 LPM (1,400 mm/s). It is to be noted that LPM is an abbreviation of line per minute and represents the rate at which 6 lines are printed per one inch. Further, the value 0.05 represents that the difference between the velocity of the tractor unit 16 and the velocity of the scuff rollers 11*d* and 11*e* is approximately 5%.

Accordingly, since the value of 140 ms is shorter than the limit idle rotation time of 500 ms at which stain to the print occurs, the continuous recording paper 1' can be transported in a slackened state when the continuous recording paper 1' is to be backwardly transported without causing stain to the print. In other words, by setting the starting time of the scuff rollers 11*d* and 11*e* to 140 to 500 ms earlier than the starting time of the tractor unit 16, forward transportation or backward transportation can be performed even if the continuous recording paper 1' is in a slackened state without contacting with the glass surface 11*j*.

The double-sided printing method of the double-sided printing apparatus 8 is explained as follows. In particular, data to be printed is printed on the front surface of the continuous recording paper 1 and the continuous recording paper 1 is transported in the forward direction by the front surface printing apparatus 9*a* shown in FIG. 1. Then, the continuous recording paper 1 is turned over to reverse the front and rear surfaces thereof and transported in the forward direction by the paper turning over mechanism (turn bar 9*b* and transport relaying apparatus 9*c*) (paper loading step). Thereafter, the continuous recording paper 1 is transported with a fixed acceleration in the forward direction so that the continuous recording paper 1 after a print image is fixed to the rear surface thereof may be taken up (scuff transport step).

Then, after a predetermined time after the scuff transport step is started, a print image is formed on the rear surface of the continuous recording paper 1 and the continuous recording paper 1 is transported with a fixed acceleration in the forward direction (main transport step). Then, before the continuous recording paper 1 transported by the main transport step is stopped, a slack amount of the continuous recording paper 1 is detected (detection step). Further, when transportation in the forward direction is to be stopped, the scuff transportation is stopped after the slack amount detected by the detection step is eliminated after the main transportation is stopped. However, when transportation in the opposite direction to the forward direction is to be stopped, the slack amount detected by the detection step after the scuff transportation is stopped is eliminated, and then the main transportation is stopped (paper tension keeping step).

Consequently, since the scuff rollers 11*d* and 11*e* are stopped earlier than the tractor unit 16, a slack corresponding to time difference is generated on the continuous recording paper 1. Therefore, rubbing between the scuff rollers 11*d* and 11*e* and the continuous recording paper 1 upon stopping of transportation of the continuous recording paper 1 is eliminated, and consequently, stain to the print can be prevented.

Thereafter, in this state, either the tractor unit 16 and the scuff rollers 11*d* and 11*e* are controlled to start backward transportation or the scuff rollers 11*d* and 11*e* are controlled to start backward transportation a little earlier than the tractor unit 16. Consequently, since the continuous recording paper 1 is backwardly transported in the slacked state, rubbing between the continuous recording paper 1 and the scuff rollers 11*d* and 11*e* can still be prevented.

Further, when next printing operation is to be started, the scuff rollers 11*d* and 11*e* are started earlier in time. Consequently, the slack of the continuous recording paper 1 is cancelled (eliminated), and printing free from stain to the print can be performed.

By the construction described above, a difference is provided between the two different starting times of the scuff rollers 11*d* and 11*e* and the tractor unit 16 so that the continuous recording paper 1 is printed on the opposite surfaces thereof and transmitted without causing stain to the print.

Figures 5A, 5B:
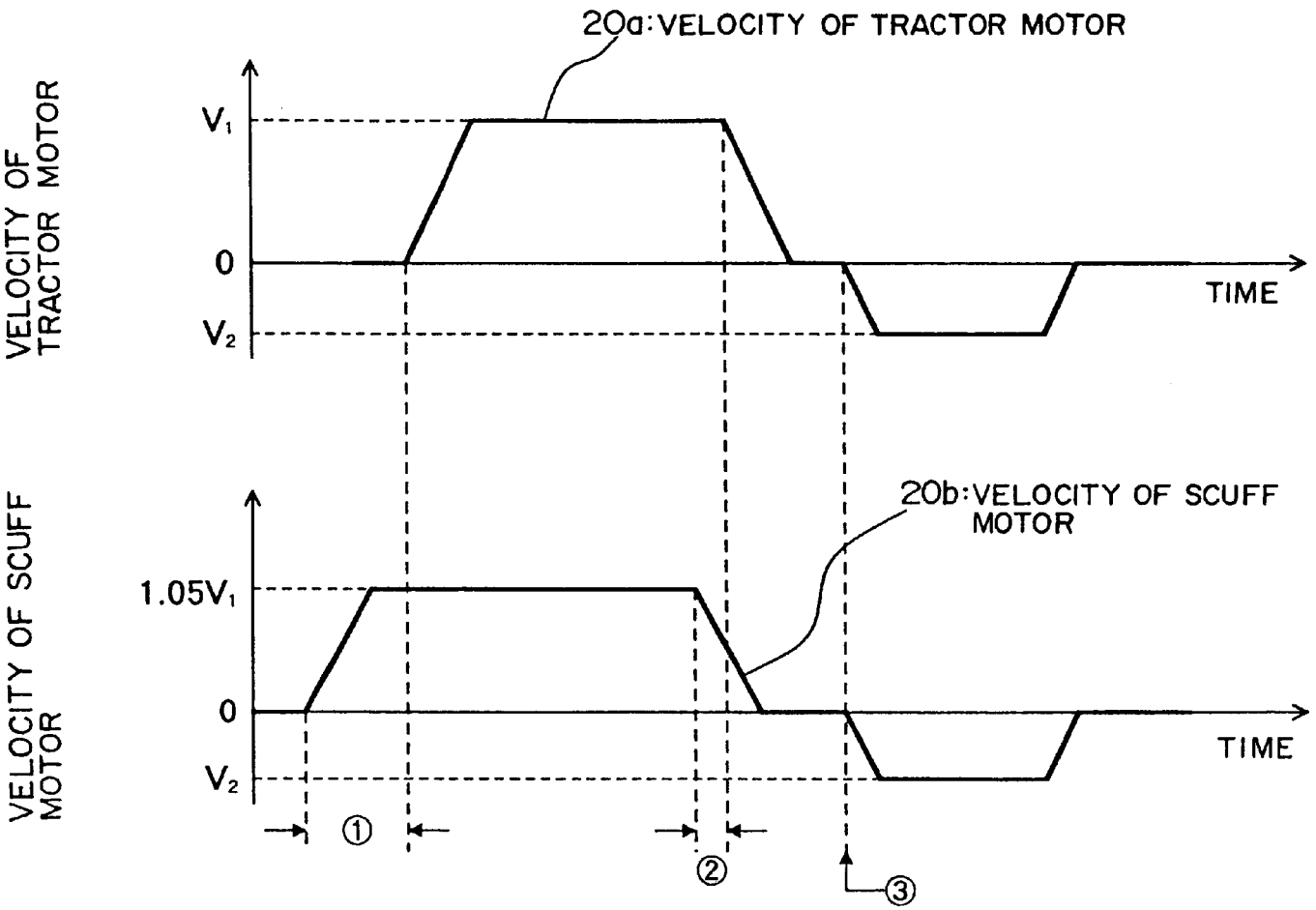
FIG. 5(*a*) is a diagram illustrating a velocity control method for a tractor motor in the first embodiment of the present invention.

FIG. 5(*a*) is a diagram illustrating a velocity controlling method for the tractor motor 16*b* in the first embodiment of the present invention, and FIG. 5(*b*) is a diagram illustrating a velocity controlling method for the scuff motor 11*d*' in the first embodiment of the present invention. FIGS. 5(*a*) and 5(*b*) show a velocity variation curve 20*a* of the tractor motor 16*b* and a velocity variation curve 20*b* of the scuff motor 11*d*', respectively. In a section denoted by ① in FIG. 5(*b*), the scuff motor 11*d*' is started first, and then, after approximately 140 ms to 500 ms, the tractor motor 16*b* is started. Then, the tractor motor 16*b* operates at a fixed velocity of $V_1$, and the scuff motor 11*d*' operates at another fixed velocity $1.05V_1$. It is to be noted that $V_1$ is a positive number.

Further, in another section denoted by ② in FIG. 5(*b*), the scuff motor 11*d*' stops earlier than the tractor motor 16*b*, and consequently, a slack is generated on the continuous recording paper 1. Then, both of the tractor motor 16*b* and the scuff motor 11*d*' are brought into a stopping state. Further, at a time point denoted by ③, either the scuff motor 11*d*' and the tractor motor 16*b* are started simultaneously, or the scuff motor 11*d*' is started a little earlier than the tractor motor 16*b*, so that backward transportation of the continuous recording paper 1 is started with a fixed acceleration.

In this manner, since a starting time difference of approximately 140 to 500 ms is present in the period of ①, rubbing of a print is eliminated, and since the continuous recording paper 1 is controlled to a condition wherein it has the predetermined tension, no stain to the print occurs. It is to be noted that, within a section from ① to ②, if the scuff rollers 11*d* and 11*e* have been started earlier, then the continuous recording paper 1 can be transported at a velocity lower than the velocity of the tractor unit 16.

Further, since the tractor motor 16*b* and the scuff motor 11*d*' are started simultaneously or the scuff motor 11*d*' is started a litter earlier than the tractor motor 16*b* at ③ after a slack is generated on the continuous recording paper 1 in ②, the continuous recording paper 1 is backwardly transported while it remains in the slackened state, and consequently, rubbing of the print can be prevented.

In this manner, even if a printed surface of the continuous recording paper 1 contacts with the scuff roller 11*d* when double-sided printing is performed by two single-sided printing apparatus connected to each other in such a state that the scuff velocity and the main transport velocity are different from each other, since no stain to the print occurs, a print image of good quality can be obtained.

(B) Second Embodiment of the Invention

As another countermeasure for allowing the continuous recording paper 1 to have a predetermined tension upon starting of printing, it is possible to perform backward transportation while the continuous recording paper 1 has some slack and then eliminate the slack after the backward transportation is stopped.

Figure 6:
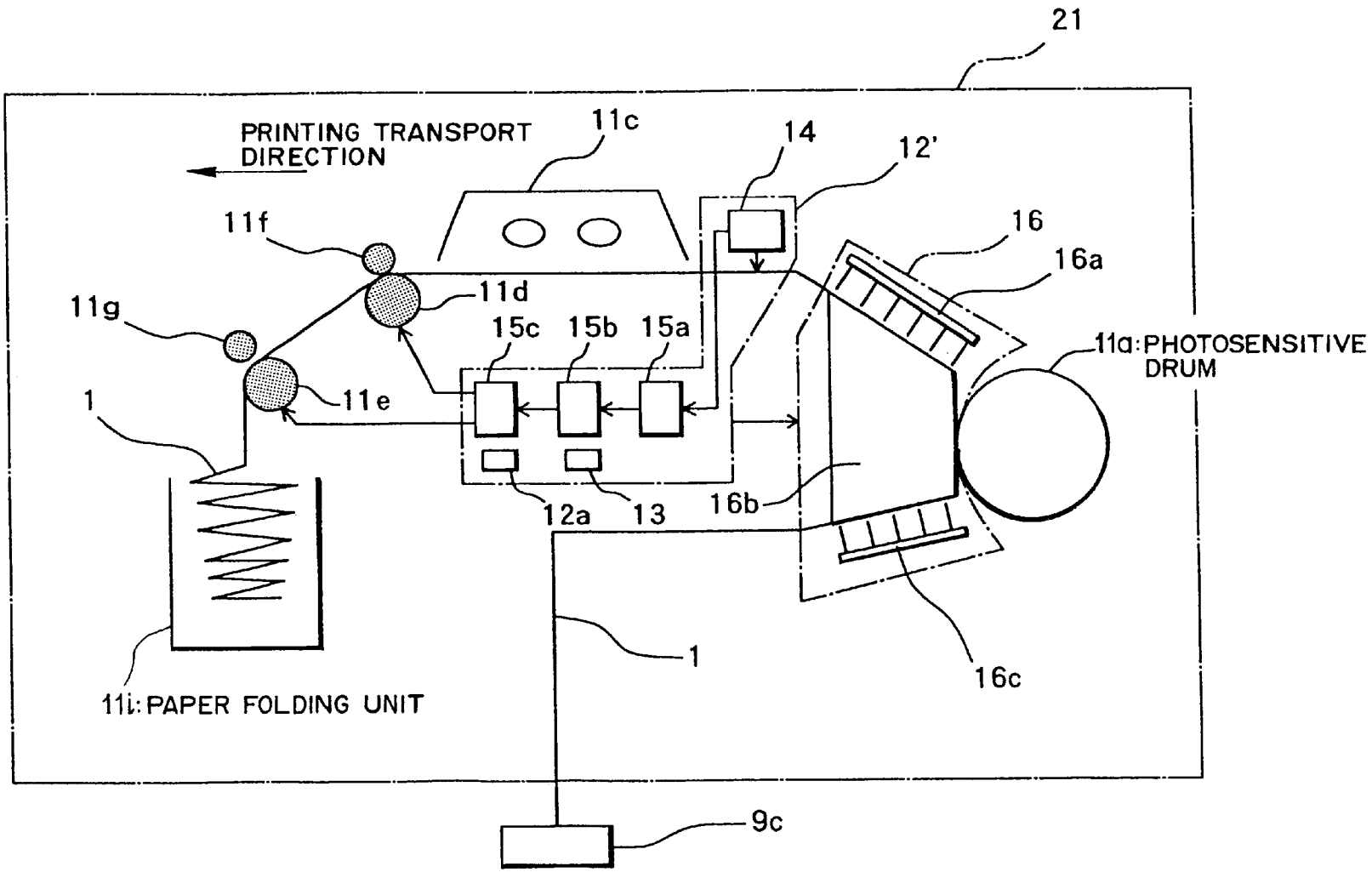
FIG. 6 is a schematic view of a rear surface printing apparatus according to a second embodiment of the present invention.

FIG. 6 is a schematic view of a rear surface printing apparatus 21 according to a second embodiment of the present invention. Referring to FIG. 6, the rear surface printing apparatus 21 shown is provided on the downstream side of the transport relaying apparatus 9*c* (refer to FIG. 1) in the forward direction, and prints on the rear surface of the continuous recording paper 1 and transports the continuous recording paper 1 in the forward direction. The rear surface printing apparatus 21 includes a photosensitive drum 11*a*, a tractor unit 16, a flash fixing unit 11*i*, a pair of scuff rollers 11*d* and 11*e*, a pair of pinch rollers 11*f* and 11*g*, a paper folding unit 11*i*, and a tension control apparatus 12'.

It is to be noted that, also in the present second embodiment, the double-sided printing apparatus 8 has the same construction as that used in the first embodiment.

The tractor unit (main transport means) 16 forms a print image on the rear surface of the continuous recording paper 1 and transports the continuous recording paper 1 in the forward direction. The tractor unit 16 includes a pair of tractor belts 16*a* and 16*c* for transporting the continuous recording paper 1, and a tractor motor 16*b* for driving the tractor belts 16*a* and 16*c*. The flash fixing unit (fixing means) 11*c* is provided on the downstream side of the tractor unit 16 in the forward direction and fixes a print image on the continuous recording paper 1 to the continuous recording paper 1. The scuff rollers 11*d* and 11*e* are provided on the downstream side of the flash fixing unit 11*c* in the forward direction and transport the continuous recording paper 1 in the forward direction.

The tension control apparatus 12' controls such that the scuff rollers 11*d* and 11*e* are stopped earlier than the tractor unit 16 to provide a predetermined slack amount to the continuous recording paper 1 and then the scuff rollers 11*d* and 11*e* and the tractor unit 16 are started at the same timing to transport the continuous recording paper 1 by a predetermined distance in the direction opposite to the forward direction to eliminate the slack amount generated on the continuous recording paper 1. The function of the tension control apparatus 12' is particularly implemented by a motor control circuit.

Figure 7:
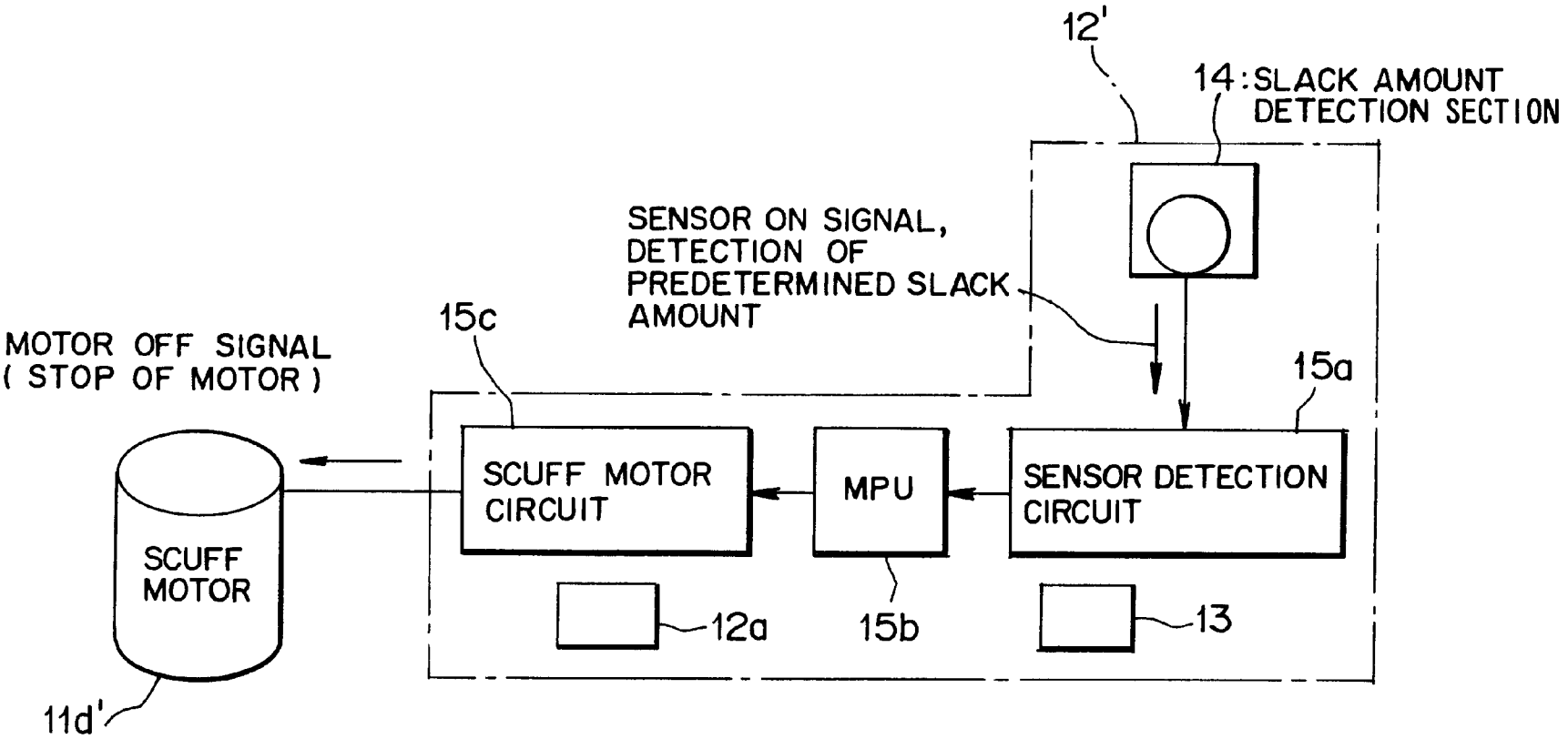
FIG. 7 is a block diagram of a tension control apparatus according to the second embodiment of the present invention.

FIG. 7 is a diagrammatic view showing a construction of the tension control apparatus 12' according to the second embodiment of the present invention. Referring to FIG. 7, the tension control apparatus 12' functions as a motor control circuit and includes a fixed acceleration control apparatus 12*a*, a feed amount management control section 13, a slack amount detection section 14, a sensor detection circuit 15*a*, an MPU (micro-processor) 15*b*, and a scuff motor circuit 15*c*. Further, a scuff motor 11*d*' for driving the scuff rollers 11*d* and 11*e* is provided on the output side of the tension control apparatus 12'. The fixed acceleration control apparatus 12*a* is similar to that described hereinabove, and further description of it is omitted here. It is to be noted that the feed amount management control section 13 is hereinafter described.

The slack amount detection section 14 detects the predetermined distance mentioned above by detecting a slack amount of a continuous medium existing between main transport means and scuff transport means and this function is realized by a laser detection sensor. The slack amount detection section 14 detects a slack amount of the continuous recording paper 1 using a laser beam of the laser detection sensor and outputs a sensor ON signal as slack amount information when it detects a predetermined slack amount. It is to be noted that the slack amount detection section 14 can be implemented even by using a micro-switch photo-sensor as hereinafter described.

The sensor detection circuit 15*a* receives the slack amount information from the slack amount detection section 14 and outputs information regarding the predetermined distance based on the slack amount information from the slack amount detection section 14 in order to eliminate the slack generated on the continuous recording paper 1. Here, the predetermined distance signifies a distance over which the continuous recording paper 1 is to be taken up.

Further, the MPU 15*b* processes a detection signal from the sensor detection circuit 15*a* and outputs a notification of a result of the processing. The scuff motor circuit 15*c* signals a control signal for controlling starting or stopping of the scuff motor 11*d*' to the scuff motor 11*d*' based on the signal outputted from the MPU 15*b*.

Thus, slack amount information is detected by the slack amount detection section 14 and inputted to the sensor detection circuit 15*a*. Then, the MPU 15*b* performs predetermined processing for the detection signal from the sensor detection circuit 15*a* and outputs a result of the processing. Further, the scuff motor circuit 15*c* signals a control signal for controlling starting or stopping of the scuff motor 11*d*' to the scuff motor 11*d*' based on the signal outputted from the MPU 15*b*. Consequently, even if the continuous recording paper 1 has some slack upon backward transportation, the magnitude of the slack can be detected, and accordingly, the continuous recording paper 1 can be prevented from contacting with the flash fixing unit 11*c*.

Figure 8:
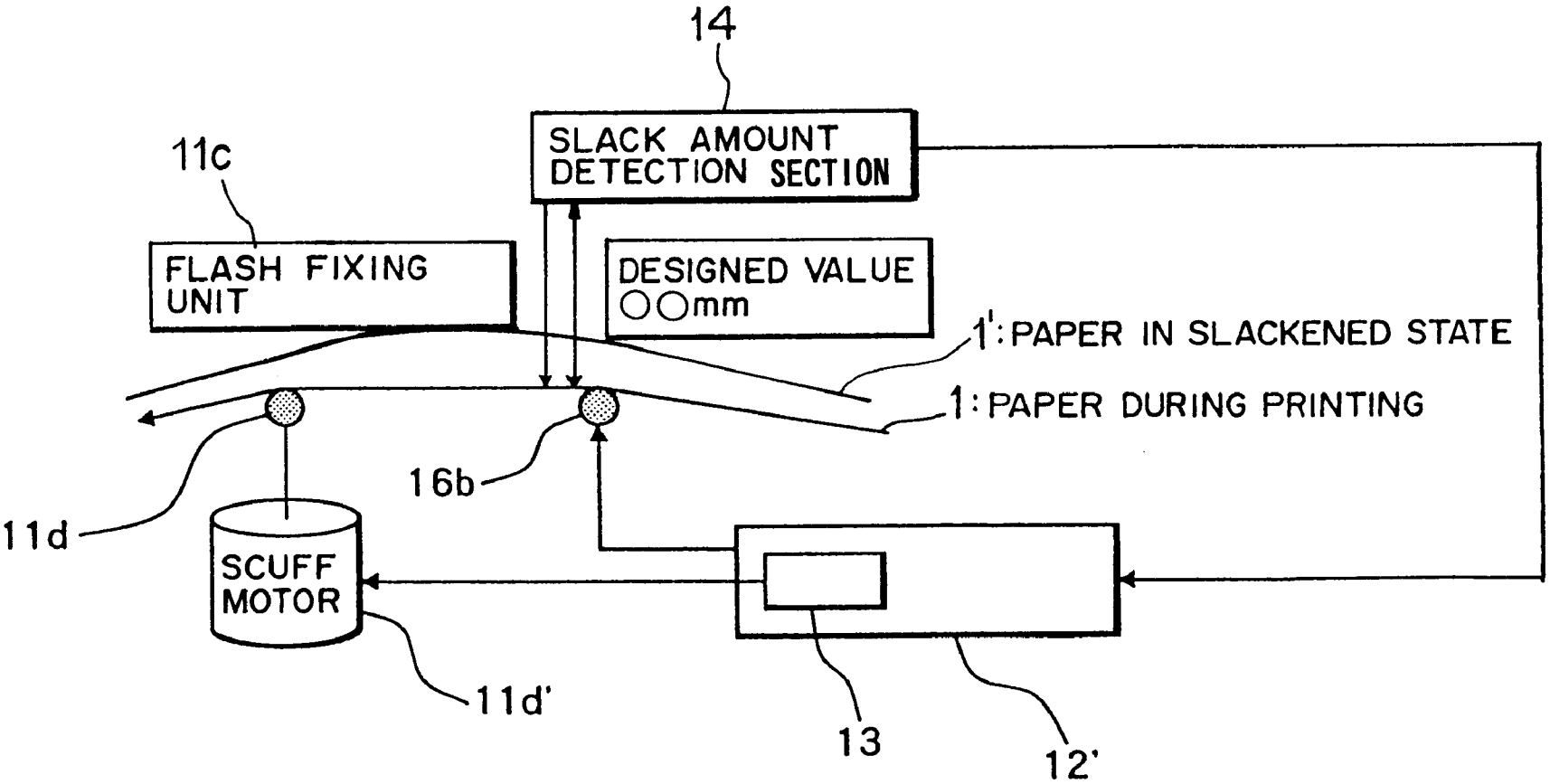
FIG. 8 is a schematic diagrammatic view showing a fixed acceleration control apparatus according to the second embodiment of the present invention.

FIG. 8 is a schematic view showing the fixed acceleration control apparatus according to the second embodiment of the present invention. Referring to FIG. 8, the continuous recording paper 1 is loaded under the flash fixing unit 11*c*, and the scuff motor 11*d*' in the scuff roller 11*d* is controlled by the feed amount management control section 13 in the tension control apparatus 12'. It is to be noted that the other components of the tension control apparatus 12' shown in FIG. 8 are not shown in FIG. 8.

The feed amount management control section 13 detects the predetermined distance from the transport amount information outputted from the scuff rollers 11*d* and 11*e*. More particularly, the feed amount management control section 13 detects the predetermined distance over which the continuous recording paper 1 is to be taken up from an encoder output of the scuff motor 11*d*'. Further, the function of the feed amount management control section 13 is realized by managing the feeding amount of the continuous recording paper 1 making use of the encoder output of the scuff motor 11*d*'. The tension control apparatus 12' defines in advance a difference between the feeding amounts of the tractor motor 16*b* in the tractor unit 16 and the scuff motor 11*d*', and the feed amount management control section 13 controls the scuff motor 11*d*' to rotate by a prescribed amount equal to the difference in feeding amount.

In this manner, the tension control apparatus 12' can use the two countermeasures of the feed amount management control section 13 and the slack amount detection section 14 to manage the slack amount of the continuous recording paper 1 to control the amount of the continuous recording paper 1 to be taken up.

Thus, as seen in FIG. 1, the continuous recording paper 1 is printed on the front surface thereof and transported in the forward direction by the front surface printing apparatus 9*a*. Then, the continuous recording paper 1 is turned over by the paper turning over means (turn bar 9*b* and transport relaying apparatus 9*c*) to reverse the front and rear surfaces thereof and is then transported in the forward direction. Thereafter, the continuous recording paper 1 is printed on the front surface thereof and transported in the forward direction by the rear surface printing apparatus 11.

The rear surface printing apparatus 11 further includes a slack amount detection section 14 for detecting a slack amount of the continuous recording paper 1 between the tractor unit 16 and the scuff rollers 11*d* and 11*e*. The tension control apparatus 12' eliminates the slack amount detected by the slack amount detection section 14 before transportation of the continuous recording paper 1 is stopped.

The double-sided printing method of the rear surface printing apparatus 11 proceeds in the following manner. In particular, data to be printed is printed on the front surface of the continuous recording paper 1, and the continuous recording paper 1 is transported in the forward direction. Then, the continuous recording paper 1 is turned over to reverse the front and rear surfaces thereof and then transported in the forward direction (paper loading step). Thereafter, a print image is formed on the rear surface of the continuous recording paper 1 and then the continuous recording paper 1 is transported with a fixed acceleration in the forward direction (scuff transport step) to start scuff transportation. The continuous recording paper 1 after a print image is fixed to the rear surface thereof simultaneously with the scuff transport step is transported with a fixed acceleration in the forward direction (main transport step).

Here, the scuff rollers 11*d* and 11*e* are rotated with a fixed acceleration and have a difference in starting time.

Thereafter, the scuff transportation is stopped and then the main transportation of the continuous recording paper 1 is stopped so that a slack is generated on the continuous recording paper 1 (slack generating step). Then, the continuous recording paper 1 is scuff transported in the direction opposite to the forward direction and simultaneously undergoes main transportation in the direction opposite to the forward direction (reverse transport step).

With the construction described above, due to the fixed acceleration control, the continuous recording paper 1 is printed on the opposite surfaces thereof and transported without causing stain to the print to occur, and backward transportation is performed while the continuous recording paper 1 has some slack, and then after the backward transportation is stopped, the slack is eliminated, thereby to prevent rubbing of the print upon starting of printing.

Figures 9A, 9B:
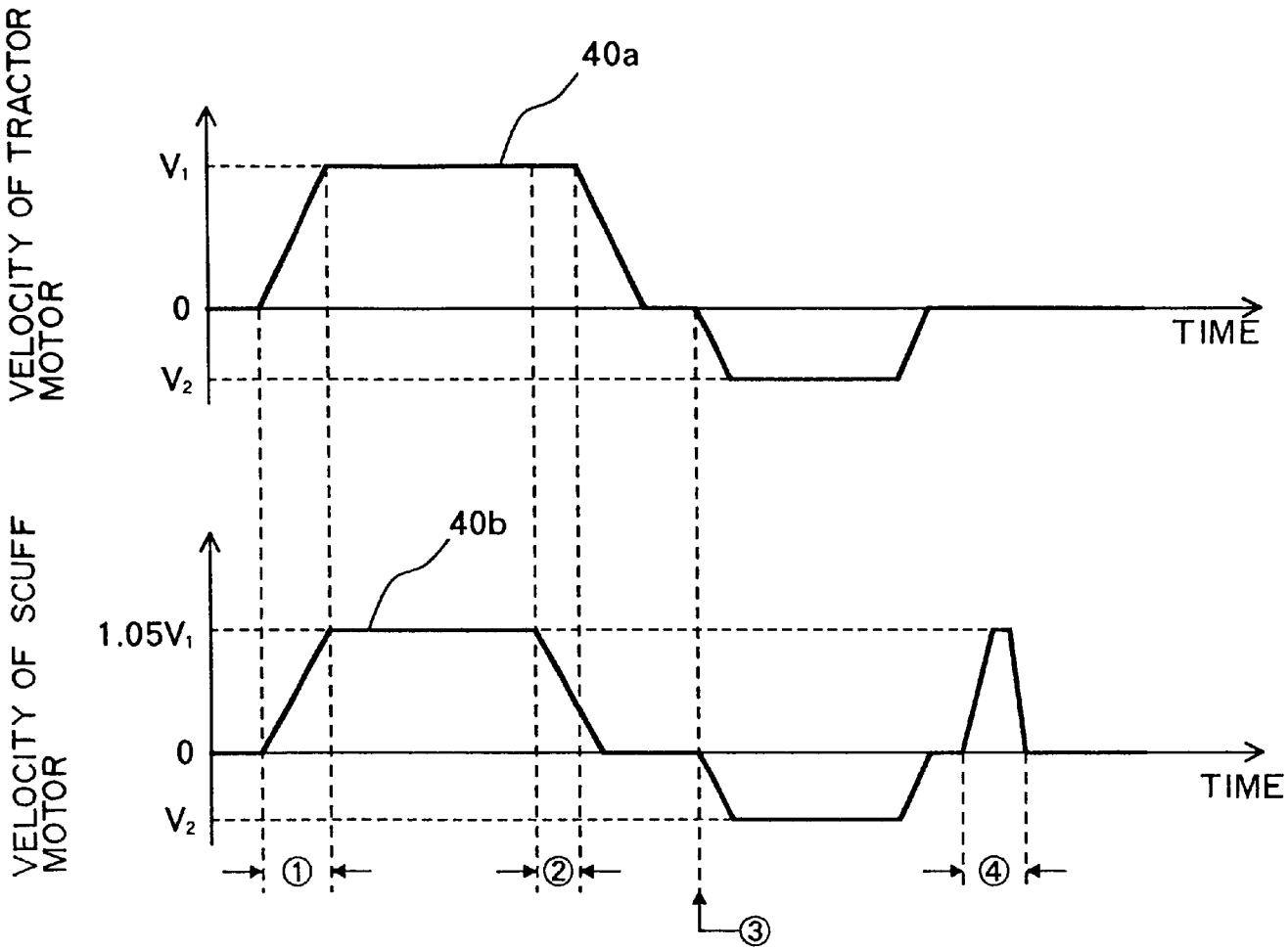
FIG. 9(*a*) is a diagram illustrating a fixed acceleration control method for a tractor motor in the second embodiment of the present invention.

FIG. 9(*a*) is a diagram illustrating the fixed acceleration control method for the tractor motor 16*b* according to the second embodiment of the present invention, and FIG. 9(*b*) is a diagram illustrating the fixed acceleration control method for the scuff motor 11*d*' according to the second embodiment of the present invention. FIGS. 9(*a*) and 9(*b*) show a velocity variation curve 40*a* of the tractor motor 16*b* and a velocity variation 40*b* of the scuff motor 11*d*', respectively. In a section denoted by ① in FIG. 9(*b*), the tractor motor 16*b* is started simultaneously with starting of the scuff motor 11*d*', and then, the tractor motor 16*b* operates at a fixed velocity $V_1$ while the scuff motor 11*d*' operates at another fixed velocity $1.05V_1$. It is to be noted that $V_1$ is a positive number.

Further, in another section denoted by ② in FIG. 9(*b*), the scuff motor 11*d*' is decelerated and stops earlier than the tractor motor 16*b*, and consequently, a slack is generated on the continuous recording paper 1. Then, both of the tractor motor 16*b* and the scuff motor 11*d*' are brought into a stopping state.

Further, at a time point denoted by ③, either the scuff motor 11*d*' and the tractor motor 16*b* are started simultaneously, or the scuff motor 11*d*' is started a little earlier than the tractor motor 16*b*, so that backward transportation of the continuous recording paper 1 is started.

Then, in a section denoted by ④, the scuff motor 11*d*' rotates by an amount equal to the slack amount to eliminate the slack of the continuous recording paper 1 in order to make preparations for starting next printing.

In this manner, since the tractor motor 16*b* and the scuff motor 11*d*' are started simultaneously in the period of ① while the continuous recording paper 1 has no slack thereon, rubbing of the print is eliminated, and since the continuous recording paper 1 is controlled to a condition wherein it has the predetermined tension, no stain to the print occurs. Further, stabilized transportation can be realized from immediately after starting of printing.

Further, since the scuff motor 11*d*' is activated earlier in the period ② in this manner, a slack is generated on the continuous recording paper 1, and since the continuous recording paper 1 is transported backwardly while it has the slackened state in ③, no slip occurs between the scuff rollers 11*d* and 11*e* and the continuous recording paper 1, and consequently, rubbing of the continuous recording paper 1 can be prevented. Furthermore, since the slack is removed by rotation in ①, no stain to the print occurs when next printing is started.

In this manner, since the scuff roller 11*d* is stopped earlier than the tractor unit 16 to generate a slack on the continuous recording paper 1 and the scuff roller 11*d* and the tractor unit 16 perform backward transportation simultaneously, no stain to the print occurs.

Further, even if a printed surface of the continuous recording paper 1 contacts with the scuff roller 11*d* when double-sided printing is performed by two single-sided printing apparatus connected to each other in such a state that the scuff transport velocity and the main transport velocity are different from each other, since no stain to the print occurs, a print image of good quality can be obtained.

(C) Others

The slack amount detection section 14 in the second embodiment described above can be implemented even by using a micro-switch photo-sensor.

Figure 10:
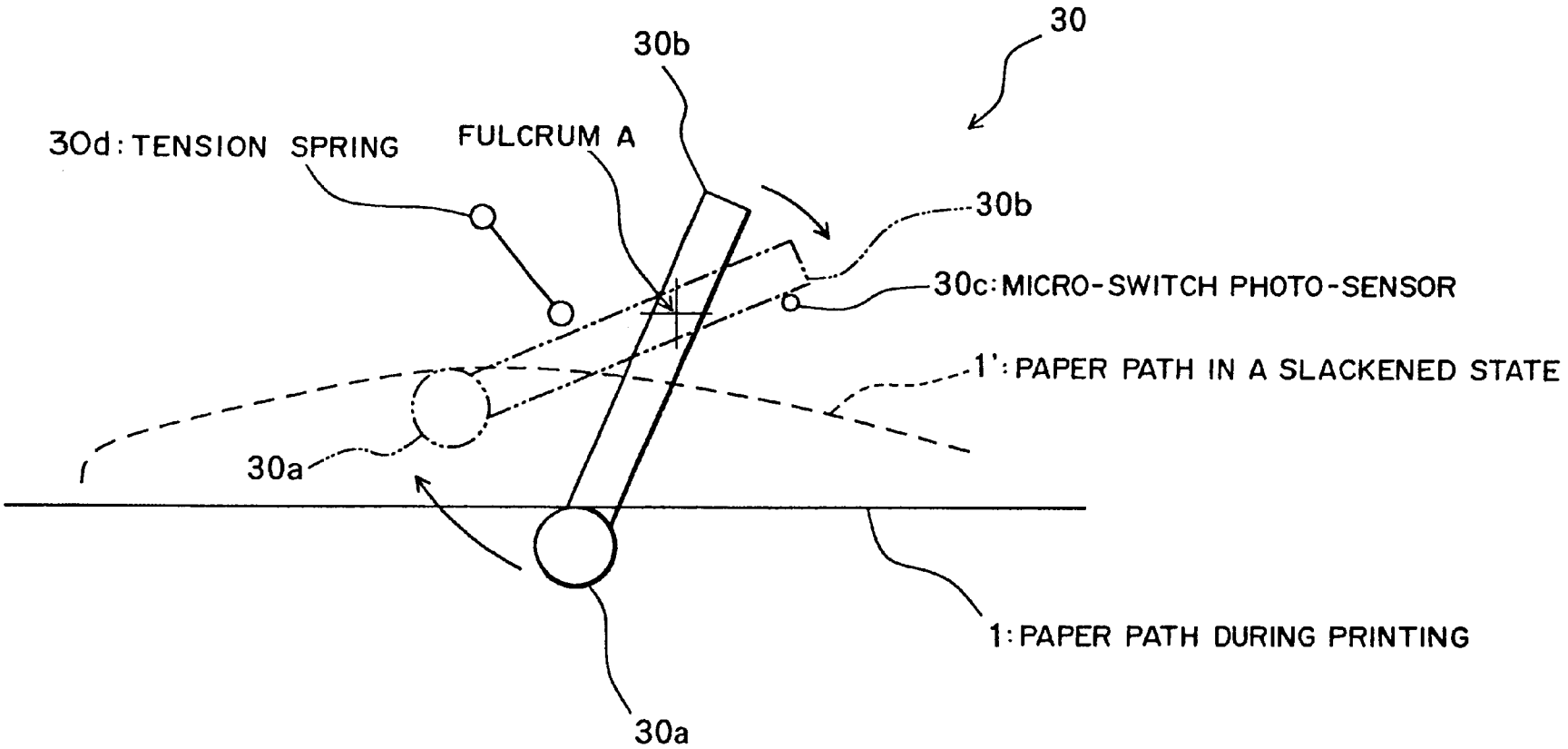
FIG. 10 is a schematic view showing a construction of a slack amount detection mechanism in which a micro switch photo-sensor is used in a further embodiment of the present invention.

FIG. 10 is a schematic view showing a construction of a slack amount detection apparatus 30 which employs a micro-switch photo-sensor according to a further embodiment of the present invention. Referring to FIG. 10, the slack amount detection apparatus 30 shown includes a float 30*a*, a lever 30*b*, a micro-switch photo-sensor 30*c*, and a tension spring 30*d*. Further, the continuous recording paper 1 shows a paper path during printing, and different continuous recording paper 1' is an imaginary line showing a paper path in a slackened state.

When the continuous recording paper 1 is brought into a slackened condition as seen from the paper path of the continuous recording paper 1', the float 30*a* is resiliently pulled up in FIG. 10 by the tension spring 30*d*, whereupon the lever 30*b* is pivoted around a fulcrum A until it is brought into contact with the micro-switch photo-sensor 30*c*, thereby to detect the slack of the continuous recording paper 1'.

Figure 11:
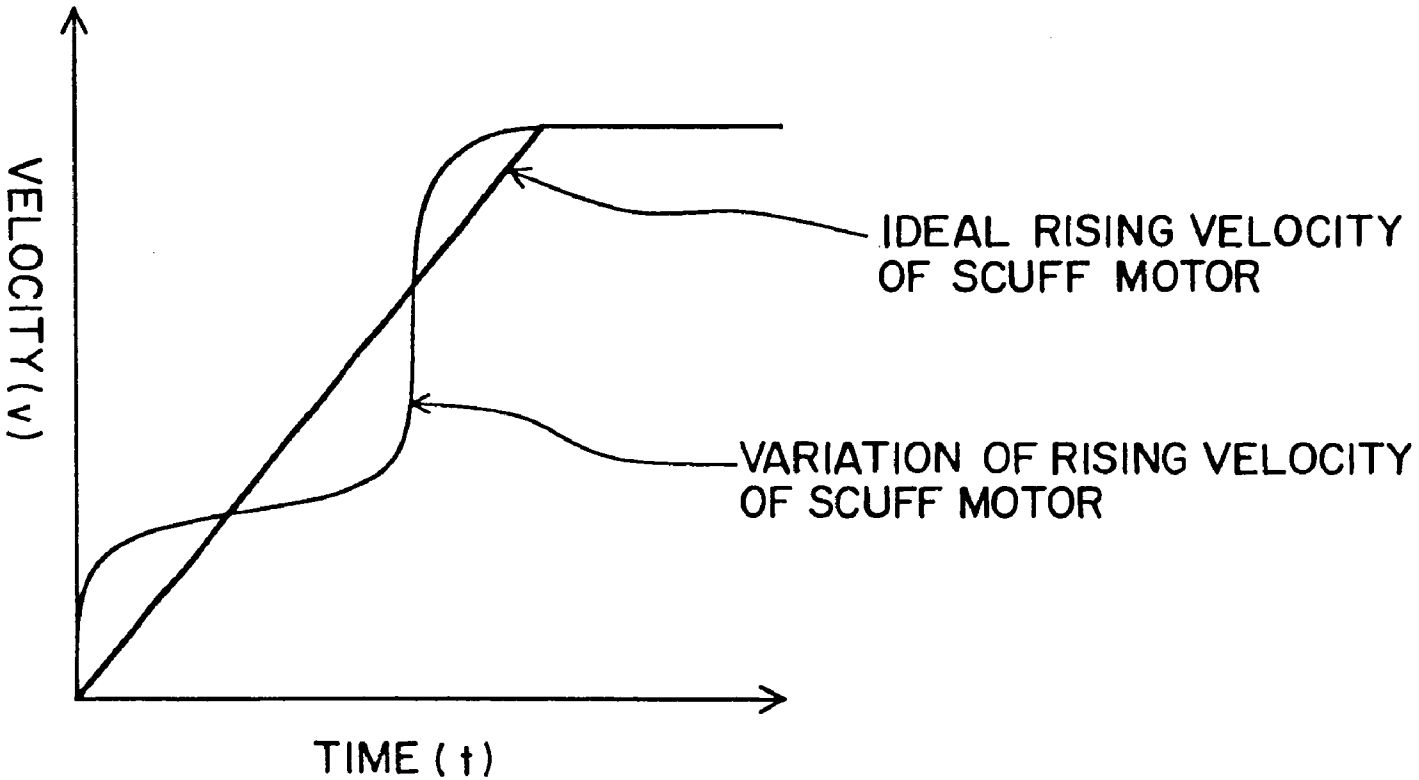
FIG. 11 is a diagram illustrating a characteristic of the velocity of a scuff motor used in a still further embodiment of the present invention.
Figure 12:
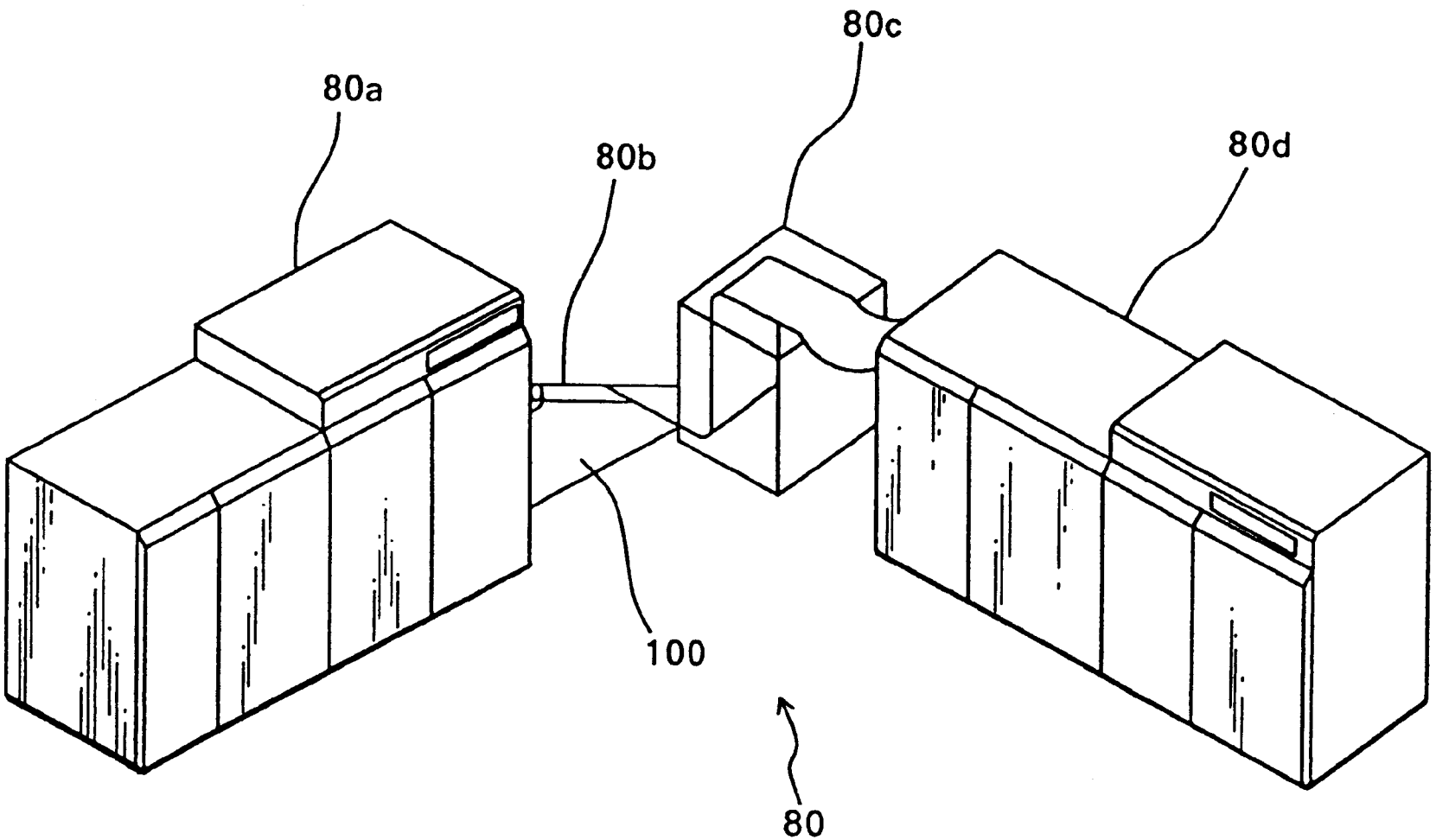
FIG. 12 PRIOR ART
FIG. 12 is a schematic view showing a construction of a double-sided printing apparatus.
Figure 13:
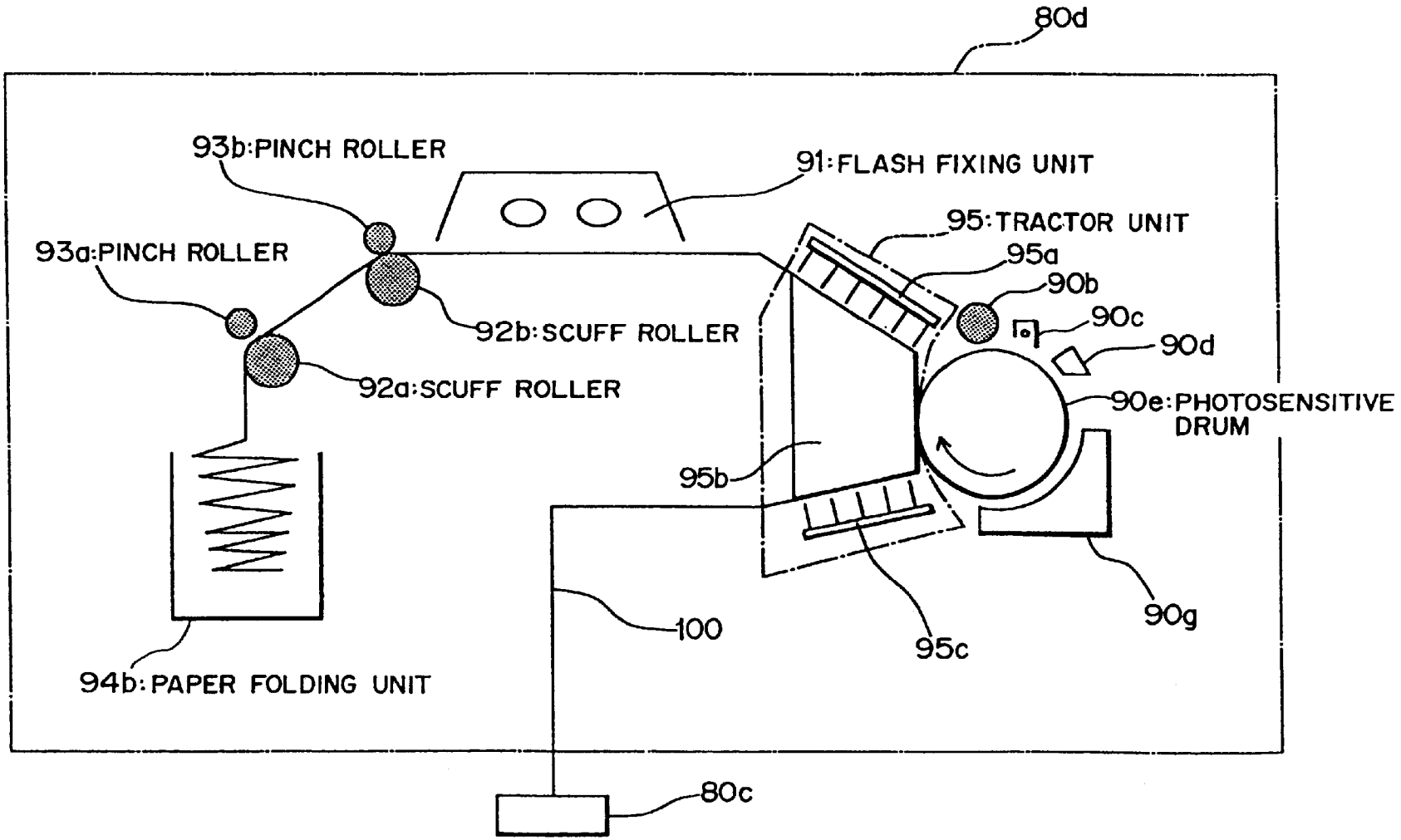
FIG. 13 PRIOR ART
FIG. 13 is a schematic view of a printer.
Figures 14A, 14B:
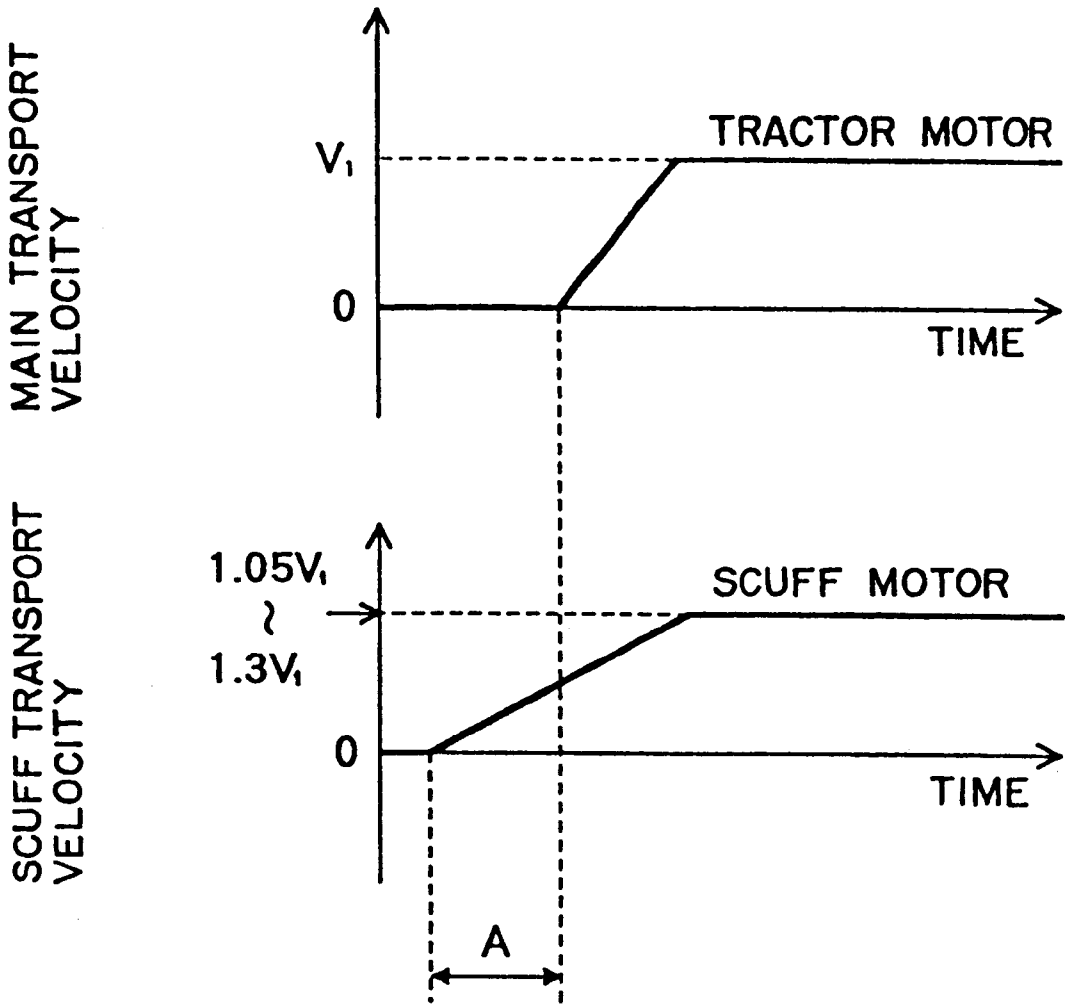
FIG. 14(a) PRIOR ART
FIG. 14(b) PRIOR ART
FIG. 14(*a*) is a diagram illustrating a velocity variation of a tractor motor upon starting of printing.
Figures 15A, 15B:
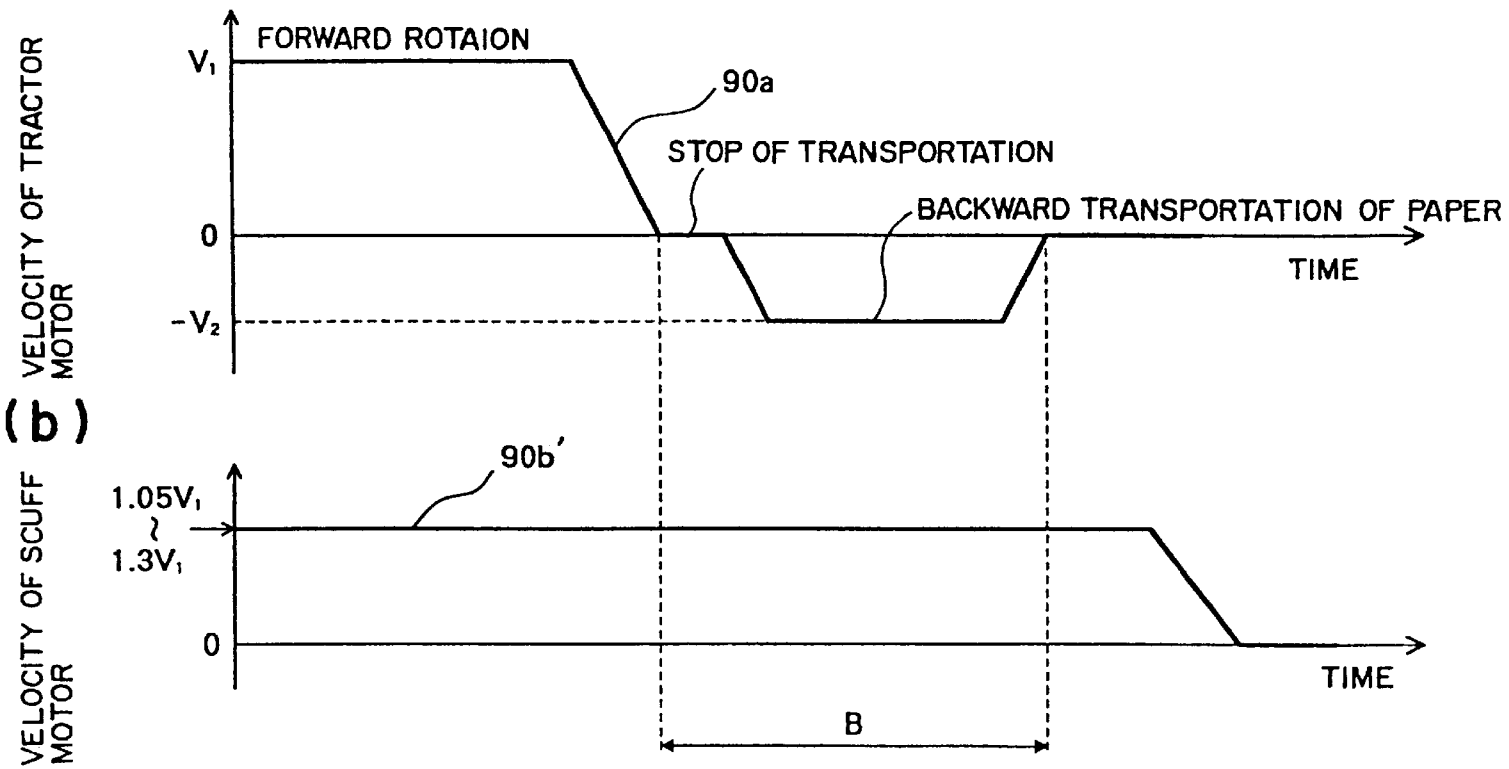
FIG. 15(a) PRIOR ART
FIG. 15(b) PRIOR ART
FIG. 15(*a*) is a diagram illustrating a velocity rotation of a tractor motor upon stopping of printing.

Further, the scuff motor 11*d*' is described with reference to FIG. 11. FIG. 11 is a diagram illustrating the velocity characteristic of the scuff motor 11*d*' according to a sill further embodiment of the present invention. Referring to FIG. 11, the velocity of the scuff motor 11*d*' exhibits a variation upon rising thereof, and this makes feeding of the continuous recording paper 1 unstable. For example, if the velocity of the scuff motor 11*d*' upon rising is set higher by approximate 5% than the velocity of the tractor unit 16, since the scuff roller 11*d* may sometimes be slower by more than approximately 10% at a certain instant upon the rising, the velocity of the scuff roller 11*d* sometimes becomes lower than the transport velocity of the tractor unit 16, which causes a slack to be produced on the continuous recording paper 1 and makes operation unstable.

Accordingly, by starting up the scuff motor 11*d*' earlier than the tractor motor 16*b*, such variations upon starting up of the motors can be eliminated thereby to achieve stabilized velocity control.

The present invention is not limited to the first and second embodiments described hereinabove and can be carried out in various forms without departing from the scope and spirit of the present invention.

For example, the definition of the front and rear surfaces of the continuous recording paper 1 in the foregoing description is given for the convenience of description, and which one of the opposite surfaces of the continuous recording paper 1 should be defined as the front surface or the rear surface can be selectively determined.

Further, in FIG. 3, the idle rotation time corresponds to the starting time difference.

What is claimed is:

1. A double-sided printing apparatus, comprising:

front surface printing means for printing on a front surface of a continuous medium and transporting the continuous medium in a printing transport direction;

paper turning over means provided on the printing transport direction side of said front surface printing means for turning over the continuous medium to reverse the front and rear surfaces of the continuous medium and transporting the continuous medium in the printing transport direction;

rear surface printing means provided on the printing transport direction side of said paper turning over means for printing on the rear surface of the continuous medium and transporting the continuous medium in the printing transport direction;

said rear surface printing means including main transport means for forming a print image on the rear surface of the continuous medium and transporting the continuous medium in the printing transport direction, fixing means provided on the printing transport direction side of said main transport means of said rear surface printing means for fixing the print image formed on the continuous medium to the continuous medium, scuff transport means provided on the printing transport direction side of said fixing means for transporting the continuous medium in the printing transport direction and outputting transport amount information, fixed acceleration control means for controlling the transport velocity of said main transport means and the transport velocity of said scuff transport means with fixed accelerations, and tension control means for controlling said main transport means and said scuff transport means so that the continuous mediun may have a predetermined tension when printing of the continuous medium is started, wherein said tension control means is arranged to control said scuff transport means and said main transport means by activating said main transport means after a predetermined time after said scuff transport means is activated.

2. A double-sided printing apparatus, comprising:

front surface printing means for printing on a front surface of a continuous medium and transporting the continuous medium in a printing transport direction;

paper turning over means provided on the printing transport direction side of said front surface printing means for turning over the continuous medium to reverse the front and rear surfaces of the continuous medium and transporting the continuous medium in the printing transport direction;

rear surface printing means provided on the printing transport direction side of said paper turning over means for printing on the rear surface of the continuous medium and transporting the continuous medium in the printing transport direction;

said rear surface printing means including main transport means for forming a print image on the rear surface of the continuous medium and transporting the continuous medium in the printing transport direction, fixing means provided on the printing transport direction side of said main transport means of said rear surface printing means for fixing the print image formed on the continuous medium to the continuous medium, scuff transport means provided on the printing transport direction side of said fixing means for transporting the continuous medium in the printing transport direction and outputting transport amount information, fixed acceleration control means for controlling the transport velocity of said main transport means and the transport velocity of said scuff transport means with fixed accelerations, and tension control means for controlling said main transport means and said scuff transport means so that the continuous medium may have a predetermined tension when printing of the continuous medium is started, wherein said tension control means is arranged to control said main transport means and said scuff transport means by stopping said scuff transport means earlier than said main transport means to generate a slack having a predetermined amount of the continuous medium and then activating said scuff transport means and said main transport means at the same time to transport the continuous medium by a predetermined distance in a direction opposite to the printing transport direction to eliminate the slack generated on the continuous medium.

3. A double-sided printing method, comprising:

a paper loading step of printing data to be printed on the front surface of a continuous medium, transporting the continuous medium in a printing transport direction, turning over the continuous medium to reverse the front and rear surfaces of the continuous medium and transporting the continuous medium in the printing transport direction;

a scuff transport step of transporting the continuous medium with a fixed acceleration in the printing transport direction to take up the continuous medium;

a main transport step of forming a print image on the rear surface of the continuous medium after a predetermined time after the scuff transport step is started and transporting the continuous medium having the print image formed on the rear surface, with a fixed acceleration in the printing transport direction;

a detection step of detecting a slack amount of the continuous medium before the continuous medium being transported by the main transport step is stopped; and a paper tension keeping step of stopping, when the transportation in the printing transport direction is to be stopped, the scuff transportation after the slack amount detected by the detection step is eliminated after the main transportation is stopped and stopping, when the transportation in a direction opposite to the printing transport direction is to be stopped, the main transportation after the slack amount detected by the detection step is eliminated after the scuff transport is stopped.

4. A double-sided printing method, comprising:

a paper loading step of printing data to be printed on the front surface of a continuous medium, transporting the continuous medium in a printing transport direction, turning over the continuous medium to reverse the front and rear surfaces of the continuous medium and transporting the continuous medium in the printing transport direction;

a scuff transport step of forming a print image on the rear surface of the continuous medium and transporting the continuous medium with a fixed acceleration in the printing transport direction; and a main transport step of transporting the continuous medium, while forming the print image fixed to the rear surface thereof, with a fixed acceleration in the printing transport direction simultaneously with the scuff transport step; thereafter a slack generating step of stopping the transportation of the continuous medium after the scuff transportation is stopped to generate a slack of the continuous medium; and a reverse transport step of transporting the continuous medium in a direction opposite to the printing transport direction at the same time as the continuous medium is transported by scuff transport means in the direction opposite to the printing transport direction.

5. A double-sided printing apparatus, comprising:

front surface printing means for printing on a front surface of a continuous medium and transporting the continuous medium in a printing transport direction;

paper turning over means provided on the printing transport direction side of said front surface printing means for turning over the continuous medium to reverse the front and rear surfaces of the continuous medium and transporting the continuous medium in the printing transport direction;

rear surface printing means provided on the printing transport direction side of said paper turning over means for printing on the rear surface of the continuous medium and transporting the continuous medium in the printing transport direction;

said rear surface printing means including main transport means for forming a print image on the rear surface of the continuous medium and transporting the continuous medium in the printing transport direction, fixing means provided on the printing transport direction side of said main transport means of said rear surface printing means for fixing the print image formed on the continuous medium to the continuous medium, scuff transport means provided on the printing transport direction side of said fixing means for transporting the continuous medium in the printing transport direction and outputting transport amount information, fixed acceleration control means for controlling the transport velocity of said main transport means and the transport velocity of said scuff transport means with fixed accelerations, and tension control means for controlling said main transport means and said scuff transport means so that the continuous medium may have a predetermined tension when printing of the continuous medium is started;

wherein said tension control means controls said main transport means and said scuff transport means by stopping said scuff transport means earlier than said main transport means to generate a slack having a predetermined amount of the continuous medium and then activating said scuff transport means and said main control means at the same time to transport the continuous medium by a predetermined distance in a direction opposite to the printing transport direction to eliminate the slack generated on the continuous medium; and wherein said tension control means includes feed amount management control means for determining the predetermined distance from the transport amount information outputted from said scuff transport means.

6. A double-sided printing apparatus, comprising:

front surface printing means for printing on a front surface of a continuous medium and transporting the continuous medium in a printing transport direction;

paper turning over means provided on the printing transport direction side of said front surface printing means for turning over the continuous medium to reverse the front and rear surfaces of the continuous medium and transporting the continuous medium in the printing transport direction;

rear surface printing means provided on the printing transport direction side of said paper turning over means for printing on the rear surface of the continuous medium and transporting the continuous medium in the printing transport direction;

said rear surface printing means including main transport means for forming a print image on the rear surface of the continuous medium and transporting the continuous medium in the printing transport direction, fixing means provided on the printing transport direction side of said main transport means of said rear surface printing means for fixing the print image formed on the continuous medium to the continuous medium, scuff transport means provided on the printing transport direction side of said fixing means for transporting the continuous medium in the printing transport direction and outputting transport amount information, fixed acceleration control means for controlling the transport velocity of said main transport means and the transport velocity of said scuff transport means with fixed accelerations, and tension control means for controlling said main transport means and said scuff transport means so that the continuous medium may have a predetermined tension when printing of the continuous medium is started;

wherein said tension control means controls said main transport means and said scuff transport means by stopping said scuff transport means earlier than said main transport means to generate a slack having a predetermined amount of the continuous medium and then activating said scuff transport means and said main control means at the same time to transport the continuous medium by a predetermined distance in a direction opposite to the printing transport direction to eliminate the slack generated on the continuous medium; and wherein said tension control means includes slack amount detection means for detecting a slack amount of the continuous medium existing between said main transport means and said scuff transport means to determine the predetermined distance.

* * * * *